US011612252B1

(12) United States Patent
Gwen

(10) Patent No.: US 11,612,252 B1
(45) Date of Patent: Mar. 28, 2023

(54) STEP STOOL AND ASSEMBLY METHODS

(71) Applicant: Patrick Gwen, Houston, TX (US)

(72) Inventor: Patrick Gwen, Houston, TX (US)

( * ) Notice: Subject to any disclaimer, the term of this patent is extended or adjusted under 35 U.S.C. 154(b) by 205 days.

(21) Appl. No.: 17/068,451

(22) Filed: Oct. 12, 2020

(51) Int. Cl.
*A47C 12/00* (2006.01)

(52) U.S. Cl.
CPC ..... *A47C 12/00* (2013.01)

(58) Field of Classification Search
CPC ..... A47C 12/00; A47C 12/02
USPC ..... 297/440.14
See application file for complete search history.

(56) References Cited

U.S. PATENT DOCUMENTS 2,669,285 A * 2/1954 Young ..... A47D 1/006 297/170
2008/0251317 A1* 10/2008 Johnson ..... A47C 12/00 182/120

FOREIGN PATENT DOCUMENTS

CA 1265734 A * 2/1990 ..... A47C 12/02
DE 9419247 U1 * 3/1995
FR 2590929 A1 * 6/1987

* cited by examiner

*Primary Examiner* — Milton Nelson, Jr.
(74) *Attorney, Agent, or Firm* — Egbert, McDaniel & Swartz, PLLC

(57) ABSTRACT

An improved step stool may include a top section and a bottom section. The bottom section may include a bottom left support, a bottom right support, a step base, and a stand base. The stand base may attach to the bottom left support and the bottom right support. The step base may attach between the bottom left support and the bottom right support. The bottom section may include one or more openings, each being adapted to receive a top/bottom connector. The top section may include a top left support, a top right support, and a lateral support. The lateral support connects between the top left support and the top right support. The top section may include one or more openings, each being adapted to receive a top/bottom connector. The top and bottom sections may be separated through by disengaging the top/bottom connectors from the top and bottom sections.

18 Claims, 18 Drawing Sheets

STEP STOOL AND ASSEMBLY METHODS

BACKGROUND OF THE INVENTIONS

1. Field of the Inventions

The present inventions generally pertain to step stools, and more particularly to improved step stools with improved capability of assembly and partial disassembly, as more fully discussed hereinbelow.

2. Description of the Related Art

Step stools are known for use by people of all ages for a variety of uses, examples of which include to assist someone in reaching an upper cabinet or shelf, to assist an elderly person getting in and out of bed, or to assist a child in reaching a sink or counter top in a kitchen or bathroom. Step stools come in a variety of shapes, sizes and structures, examples of which include folding or fixed. Step stools can be provided with any number of steps, common examples including single-step, two-step and three-step stools. Step stools can be assembled in a variety of ways. One of the drawbacks to existing step stools is that various components of step stools cannot be easily separated for particular uses.

There is thus a need for an improved step stool, which by virtue of its design and components would be able to address at least one of the above-mentioned needs, or overcome or at least minimize at least one of the above-mentioned drawbacks. As will become apparent from the description and explanation set forth below, the present inventions overcome the above-described problem.

SUMMARY OF THE INVENTIONS

In one aspect, the present inventions may include an improved step stool comprising: a bottom section; a top section; and a plurality of top/bottom connectors; the bottom section and the top section being removably attachable to one another; the bottom section including a bottom left support, a bottom right support, a step base and a stand base, the bottom left support and the bottom right support being spaced apart and connected by the stand base and the step base, the stand base being attached to a top edge of the bottom left support and a top edge of the bottom right support, the step base being attached between the bottom left support and the bottom right support, the step base being disposed below the stand base and nearer front edges of the bottom left support and the bottom right support than the stand base, the bottom section including at least one left opening formed through a left edge of the stand base and into the top edge of the bottom left support, the at least one left opening being adapted to receive a portion of one of the plurality of top/bottom connectors, the bottom section including at least one right opening formed through a right edge of the stand based and into the top edge of the bottom right support, the at least one right opening being adapted to receive a portion of one of the plurality of top/bottom connectors; and the top section including a top left support, a top right support, and a lateral support, the top left support and the top right support being spaced apart and connected by the lateral support, the top section including at least one upper left opening extending upwardly into the top left support from a lower edge of the top left support, the at least one upper left opening being adapted to receive a portion of the top/bottom connector disposed in the at least one left opening formed through the left edge of the stand base and into the top edge of the bottom left support, the top section including at least one upper right opening extending upwardly into the top right support from a lower edge of the top right support, the at least one upper right opening being adapted to receive a portion of the top/bottom connector disposed in the at least one right opening formed through the right edge of the stand base and into the top edge of the bottom right support. Another feature of this aspect of the present inventions may further include a bottom back support connected between the bottom left support and the bottom right support. Another feature of this aspect of the present inventions may be that the lateral support is one of a top back support and a cross bar. Another feature of this aspect of the present inventions may be that each of the at least one left opening, the at least one right opening, the at least one upper left opening, and the at least one upper right opening is a cylindrical bore hole, and each of the plurality of top/bottom connectors is in the shape of a cylinder. Another feature of this aspect of the present inventions may be that each of the at least one left opening, the at least one right opening, the at least one upper left opening, and the at least one upper right opening is a cylindrical bore hole, and each of the plurality of top/bottom connectors is an aluminum cylinder. Another feature of this aspect of the present inventions may be that each aluminum cylinder has a wall thickness of 0.05 inches. Another feature of this aspect of the present inventions may be that the bottom left support includes at least one opening aligned with the at least one left opening and through which a fastener is installed to secure one of the plurality of top/bottom connectors to the bottom left support; the bottom right support includes at least one opening aligned with the at least one right opening and through which a fastener is installed to secure one of the plurality of top/bottom connectors to the bottom right support; the top left support includes at least one opening aligned with the at least one upper left opening and through which a fastener is installed to secure one of the plurality of top/bottom connectors to the top left support; and the top right support includes at least one opening aligned with the at least one upper right opening and through which a fastener is installed to secure one of the plurality of top/bottom connectors to the top right support. Another feature of this aspect of the present inventions may be that the bottom left support includes at least one left upstanding connector extending from the top edge of the bottom left support, the at least one left upstanding connector being adapted for engagement with at least one left opening adjacent a left edge of the stand base; and the bottom right support includes at least one right upstanding connector extending from the top edge of the bottom right support, the at least one right upstanding connector being adapted for engagement with at least one right opening adjacent a right edge of the stand base.

In another aspect, the present inventions may include an improved step stool comprising: a bottom section; a top section; a first left top/bottom connector; a second left top/bottom connector; a first right top/bottom connector; and a second right top/bottom connector; the bottom section and the top section being removably attachable to one another; the bottom section including a bottom left support, a bottom right support, a step base and a stand base, the bottom left support and the bottom right support being spaced apart and connected by the stand base and the step base, the stand base being attached to a top edge of the bottom left support and a top edge of the bottom right support, the step base being attached between the bottom left support and the bottom right support, the step base being disposed below the stand base and nearer front edges of the bottom left support and the bottom right support than the stand base; the bottom section including a first left opening and a second left opening, the first left opening and the second left opening being formed through a left edge of the stand base and into the top edge of the bottom left support, the first left opening being adapted to receive a portion of the first left top/bottom connector, and the second left opening being adapted to receive a portion of the second left top/bottom connector; the bottom section including a first right opening and a second right opening, the first right opening and the second right opening being formed through a right edge of the stand base and into the top edge of the bottom right support, the first right opening being adapted to receive a portion of the first right top/bottom connector, and the second left opening being adapted to receive a portion of the second right top/bottom connector; the top section including a top left support, a top right support, and a lateral support, the top left support and the top right support being spaced apart and connected by the lateral support; the top section including a first upper left opening extending upwardly into the top left support from a lower edge of the top left support, and a second upper left opening extending upwardly into the top left support from the lower edge of the top left support, the first upper left opening being adapted to receive a portion of the first left top/bottom connector, and the second upper left opening being adapted to receive a portion of the second left top/bottom connector; and the top section including a first upper right opening extending upwardly into the top right support from a lower edge of the top right support, and a second upper right opening extending upwardly into the top right support from the lower edge of the top right support, the first upper right opening being adapted to receive a portion of the first right top/bottom connector, and the second upper right opening being adapted to receive a portion of the second right top/bottom connector. Another feature of this aspect of the present inventions may further include a bottom back support connected between the bottom left support and the bottom right support. Another feature of this aspect of the present inventions may be that the lateral support is one of a top back support and a cross bar. Another feature of this aspect of the present inventions may be that each of the first left opening, the second left opening, the first right opening, the second right opening, the first upper left opening, the second upper left opening, the first upper right opening, and the second upper right opening is a cylindrical bore hole, and each of the top/bottom connectors is in the shape of a cylinder. Another feature of this aspect of the present inventions may be that each of the first left opening, the second left opening, the first right opening, the second right opening, the first upper left opening, the second upper left opening, the first upper right opening, and the second upper right opening is a cylindrical bore hole, and each of the top/bottom connectors is an aluminum cylinder. Another feature of this aspect of the present inventions may be that each aluminum cylinder has a wall thickness of 0.05 inches. Another feature of this aspect of the present inventions may be that the bottom left support includes at least one opening aligned with the first left opening and through which a fastener is installed to secure the first left top/bottom connector to the bottom left support; the bottom left support includes at least one opening aligned with the second left opening and through which a fastener is installed to secure the second left top/bottom connector to the bottom left support; the bottom right support includes at least one opening aligned with the first right opening and through which a fastener is installed to secure the first right top/bottom connector to the bottom right support; the bottom right support includes at least one opening aligned with the second right opening and through which a fastener is installed to secure the second right top/bottom connector to the bottom right support; the top left support includes at least one opening aligned with the first upper left opening and through which a fastener is installed to secure the first left top/bottom connector to the top left support; the top left support includes at least one opening aligned with the second upper left opening and through which a fastener is installed to secure the second left top/bottom connector to the top left support; the top right support includes at least one opening aligned with the first upper right opening and through which a fastener is installed to secure the first right top/bottom connector to the top right support; and the top right support includes at least one opening aligned with the second upper right opening and through which a fastener is installed to secure the second right top/bottom connector to the top right support. Another feature of this aspect of the present inventions may be that the bottom left support includes at least one left upstanding connector extending from the top edge of the bottom left support, the at least one left upstanding connector being adapted for engagement with at least one left opening adjacent a left edge of the stand base; and the bottom right support includes at least one right upstanding connector extending from the top edge of the bottom right support, the at least one right upstanding connector being adapted for engagement with at least one right opening adjacent a right edge of the stand base.

In another aspect, the present inventions may include a method of detaching a top section of a step stool from a bottom section of a step stool, the top section and bottom section being connected by a plurality of top/bottom connectors, the bottom section including a bottom left support, a bottom right support, a step base and a stand base, the bottom left support and the bottom right support being spaced apart and connected by the stand base and the step base, the stand base being attached to a top edge of the bottom left support and a top edge of the bottom right support, the step base being attached between the bottom left support and the bottom right support, the step base being disposed below the stand base and nearer front edges of the bottom left support and the bottom right support than the stand base, the bottom section including at least one left opening formed through a left edge of the stand base and into the top edge of the bottom left support, the at least one left opening being adapted to receive a portion of one of the plurality of top/bottom connectors, the bottom section including at least one right opening formed through a right edge of the stand based and into the top edge of the bottom right support, the at least one right opening being adapted to receive a portion of one of the plurality of top/bottom connectors, and the top section including a top left support, a top right support, and a lateral support, the top left support and the top right support being spaced apart and connected by the lateral support, the top section including at least one upper left opening extending upwardly into the top left support from a lower edge of the top left support, the at least one upper left opening being adapted to receive a portion of the top/bottom connector disposed in the at least one left opening formed through the left edge of the stand base and into the top edge of the bottom left support, the top section including at least one upper right opening extending upwardly into the top right support from a lower edge of the top right support, the at least one upper right opening being adapted to receive a portion of the top/bottom connector disposed in the at least one right opening formed through the right edge of the stand base and into the top edge of the bottom right support, the method comprising the steps of: removing each of the plurality of top/bottom connectors from the left opening, the right opening, the upper left opening, and the upper right opening; and separating the top section from the bottom section. Another feature of this aspect of the present inventions may further include positioning a button in each of the left opening, the right opening, the upper left opening, and the upper right opening.

Other features, aspects and advantages of the present inventions will become apparent from the following discussion and detailed description.

While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTION

Figure 1:
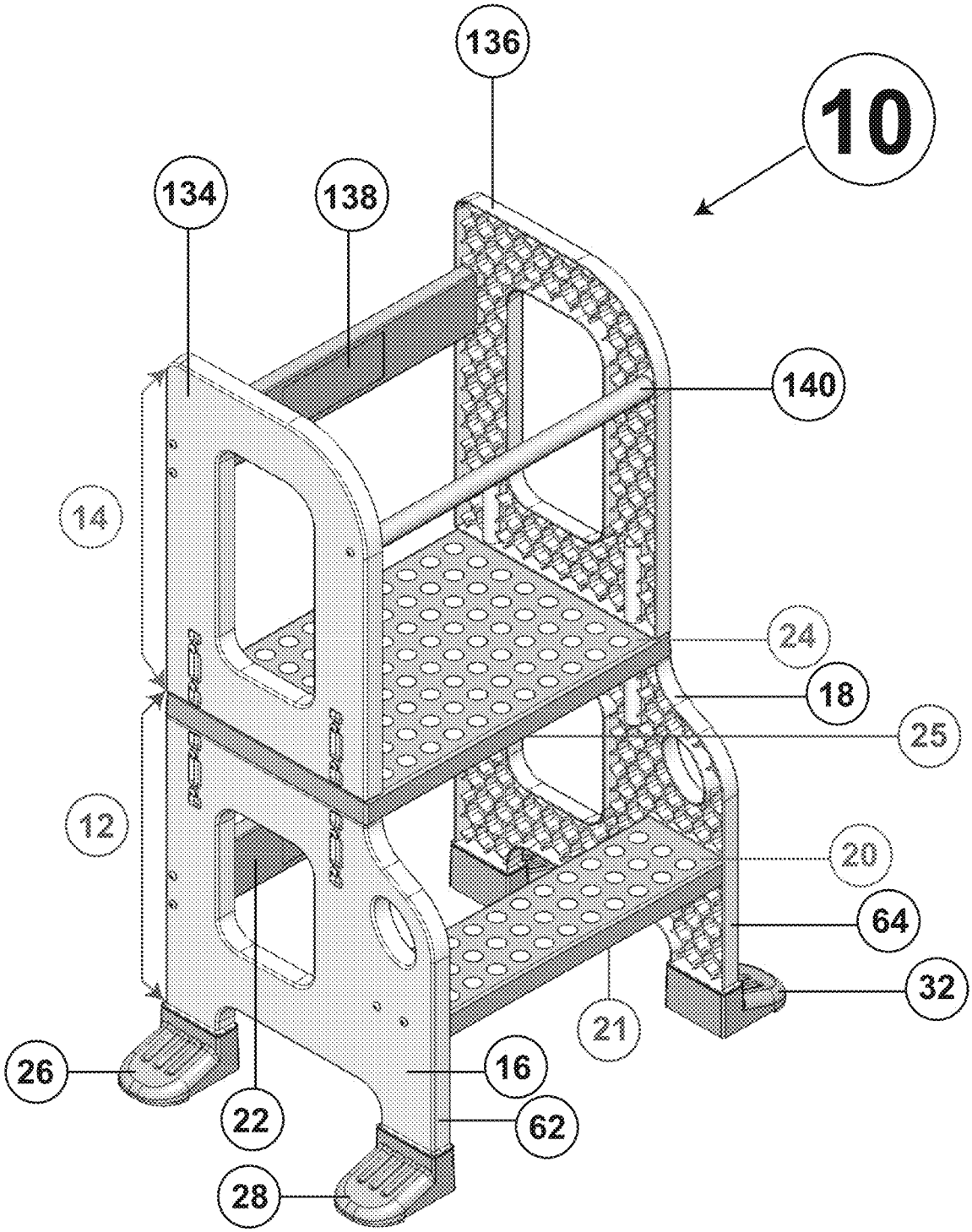
FIG. 1 is a perspective view of a specific embodiment of an improved step stool in accordance with the present inventions.

Referring to the drawings in detail, wherein like numerals denote identical elements throughout the several views, and referring initially to FIG. 1, there is shown a perspective view of a specific embodiment of an improved step stool 10 according to the present inventions. In a specific embodiment, the step stool 10 may include a bottom section 12 and a top section 14. In a specific embodiment, the bottom section 12 may include a bottom left support 16, a bottom right support 18, step base 20, a bottom back support 22, and a stand base 24. In a specific embodiment, the bottom left support 16 may include a left rear foot 26 at a lower rear portion of the bottom left support 16, and a left front foot 28 at a lower front portion of the bottom left support 16. In a specific embodiment, the bottom right support 18 may include a right rear foot 30 at a lower rear portion of the bottom right support 18, and a right front foot 32 at a lower front portion of the bottom right support 18.

In a specific embodiment, the bottom left support 16 and the bottom right support 18 may be positioned in generally vertical planes that are spaced apart from and generally parallel to each other. In a specific embodiment, the step base 20 may be attached to and between front sides of the bottom left support 16 and the bottom right support 18 in a generally horizontal plane. In a specific embodiment, the bottom back support 22 may be attached to and between rear edges of the bottom left support 16 and the bottom right support 18 in a generally vertical plane, as more clearly seen in FIGS. 4-6, for example. In a specific embodiment, the stand base 24 may be attached to top edges of the bottom left support 16 and the bottom right support 18 in a generally horizontal plane. Additional details of the stand base 24 are described below. In a specific embodiment, the width of the bottom left support 16 and the bottom right support 18 at their top edges is less than the width of the bottom left support 16 and the bottom right support 18 at their lower portions, such as near the feet 26-32. In this manner, a front edge 25 of the stand base 24 is spaced inwardly and apart from a front edge 21 of the step base 20, so that the front edge 21 of the step base 20 is closer than the front edge 25 of the stand base 24 to a lower front edge 62 of the bottom left support 16 and to a lower front edge 64 of the bottom right support 18.

Figure 2:
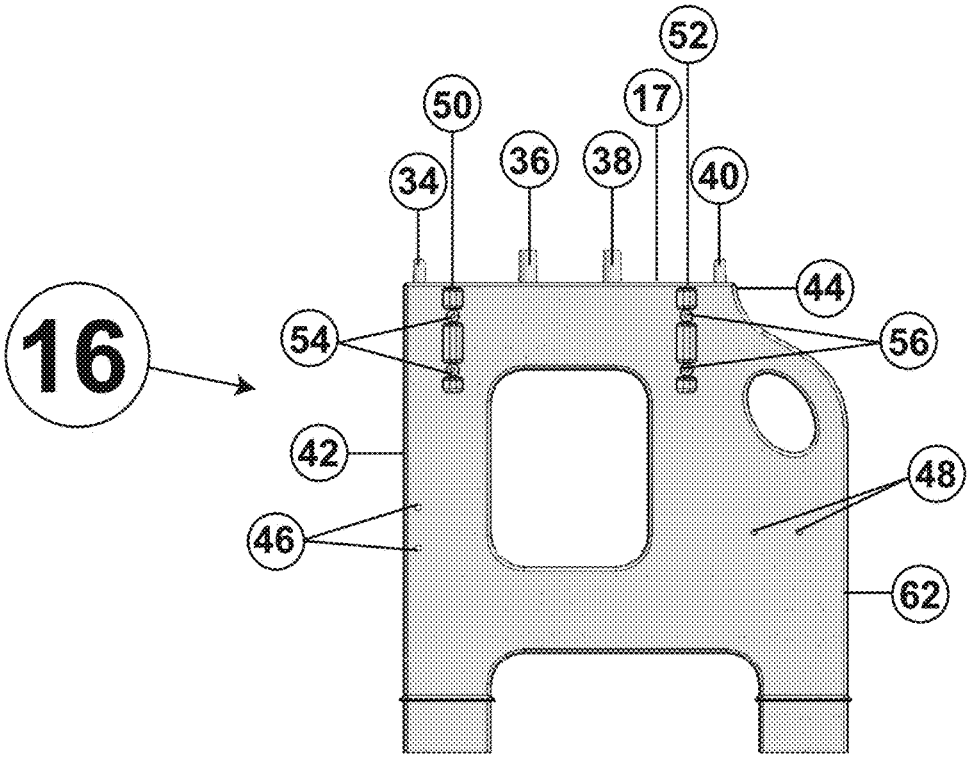
FIG. 2 is a side view of a bottom left support that forms part of a specific embodiment of an improved step stool in accordance with the present inventions.
Figure 3:
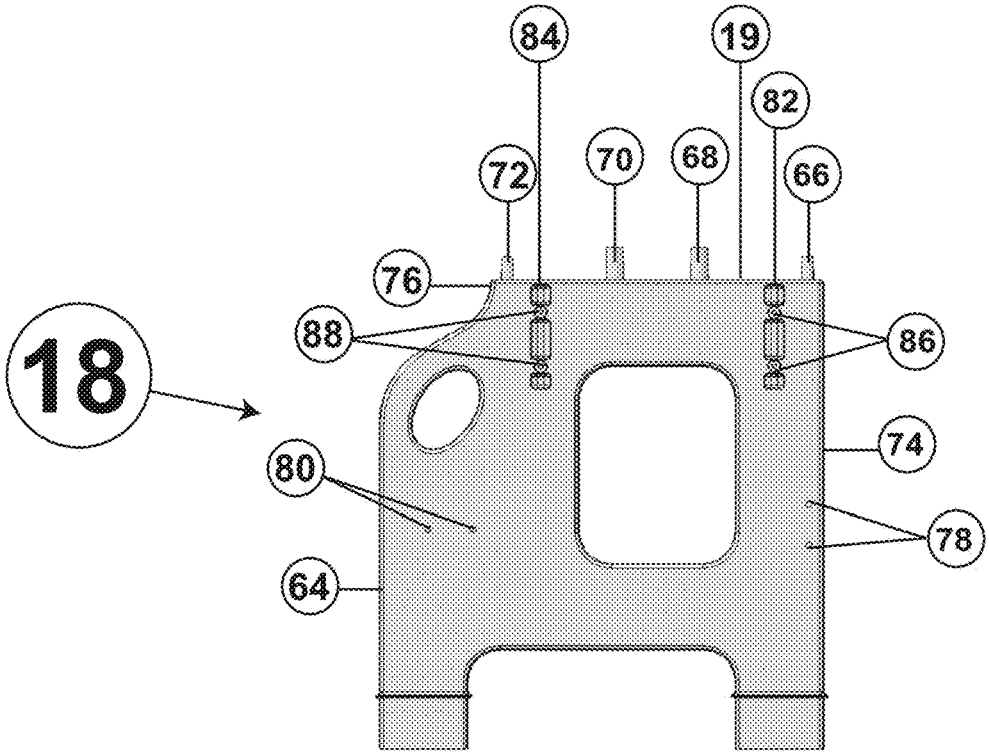
FIG. 3 is a side view of a bottom right support that forms part of a specific embodiment of an improved step stool in accordance with the present inventions.

Side views of the bottom left support 16 and the bottom right support 18 are shown in FIGS. 2 and 3, respectively. With reference to FIG. 2, in a specific embodiment, the bottom left support 16 may be provided with a plurality of upstanding connectors 34-40 extending upwardly from a top edge 17 of the bottom left support 16. In a specific embodiment, the bottom left support 16 may include: a first left upstanding connector 34 adjacent a rear edge 42 of the bottom left support 16; a second left upstanding connector 36; a third left upstanding connector 38; and a fourth left upstanding connector 40, which may be disposed adjacent a top front edge 44 of the bottom left support 16. In a specific embodiment, the second left and third left upstanding connectors 36 and 38 may be disposed between the first left and fourth left upstanding connectors 34 and 40. In a specific embodiment, the left upstanding connectors 34-40 may be round rods, or may have any other cross section, such as square or hexagonal, for example. In a specific embodiment, the diameter or width of the second left and third left upstanding connectors 36 and 38 may be larger than the diameter or width of the first left and fourth left upstanding connectors 34 and 40. In a specific embodiment, the first left and fourth left upstanding connectors 34 and 40 may be adapted to receive screws used to secure the stand base 24 to the bottom left support 16, as further explained below. As will be explained further below, the left upstanding connectors 34-40 function to mate with corresponding openings on a left edge of the stand base 24.

FIG. 2 further shows that, in a specific embodiment, the bottom left support 16 may further include openings 46 to receive screws to fasten the bottom left support 16 to the bottom back support 22, as further described below. FIG. 2 further shows that, in a specific embodiment, the bottom left support 16 may further include openings 48 to receive screws to fasten the bottom left support 16 to the step base 20, as further described below. FIG. 2 also shows that, in a specific embodiment, the bottom left support 16 may further include a first left bore hole or opening 50 extending downwardly from the top edge 17 of the bottom left support 16, and a second left bore hole or opening 52 extending downwardly from the top edge 17 of the bottom left support 16, as further discussed below. In a specific embodiment, the first left and second left bore holes or openings 50 and 52 may have a round cross-section or any other cross-sectional profile, including for example, square or hexagonal, or any other shape. In a specific embodiment, the first left bore hole 50 may be disposed adjacent the rear edge 42 of the bottom left support 16, and the second left bore hole 52 may be disposed adjacent the top front edge 44 of the bottom left support 16.

FIG. 2 also shows that, in a specific embodiment, the bottom left support 16 may include openings 54 aligned with a centerline of the first left bore hole/opening 50 to receive screws to fasten a first left top/bottom connector 58 (shown for example in FIG. 7 discussed below) to the bottom left support 16. In a specific embodiment, the bottom left support 16 may include openings 56 aligned with a centerline of the second left bore hole/opening 52 to receive screws to fasten a second left top/bottom connector 60 (shown for example in FIG. 7 discussed below) to the bottom left support 16. The function of the first left top/bottom connector 58 and the second left top/bottom connector 60 is described below.

Referring now to FIG. 3, in a specific embodiment, the bottom right support 18 may be provided with a plurality of upstanding connectors 66-72 extending upwardly from a top edge 19 of the bottom right support 18. In a specific embodiment, the bottom right support 18 may include: a first right upstanding connector 66 adjacent a rear edge 74 of the bottom right support 18; a second right upstanding connector 68; a third right upstanding connector 70; and a fourth right upstanding connector 72, which may be disposed adjacent a top front edge 76 of the bottom right support 18. In a specific embodiment, the second right and third right upstanding connectors 68 and 70 may be disposed between the first right and fourth right upstanding connectors 66 and 72. In a specific embodiment, the upstanding connectors 66-72 may be round rods, or may have any other cross section, such as square or hexagonal, for example. In a specific embodiment, the diameter or width of the second right and third right upstanding connectors 68 and 70 may be larger than the diameter or width of the first right and fourth right upstanding connectors 66 and 72. In a specific embodiment, the first right and fourth right upstanding connectors 66 and 72 may be adapted to receive screws used to secure the stand base 24 to the bottom right support 18, as further explained below. As will be explained further below, the upstanding connectors 66-72 function to mate with corresponding openings on right edge of the stand base 24.

FIG. 3 further shows that, in a specific embodiment, the bottom right support 18 may further include openings 78 to receive screws to fasten the bottom right support 18 to the bottom back support 22, as further described below. FIG. 3 further shows that, in a specific embodiment, the bottom right support 18 may further include openings 80 to receive screws to fasten the bottom right support 18 to the step base 20, as further described below. FIG. 3 also shows that, in a specific embodiment, the bottom right support 16 may further include a first right bore hole or opening 82 extending downwardly from the top edge 19 of the bottom right support 18, and a second right bore hole or opening 84 extending downwardly from the top edge 19 of the bottom right support 18, as further discussed below. In a specific embodiment, the first right and second right bore holes or openings 82 and 84 may have a round cross-section or any other cross-sectional profile, including for example, square or hexagonal, or any other shape. In a specific embodiment, the first right bore hole 82 may be disposed adjacent the rear edge 74 of the bottom right support 18, and the second right bore hole 84 may be disposed adjacent the top front edge 76 of the bottom right support 18.

FIG. 3 also shows that, in a specific embodiment, the bottom right support 18 may include openings 86 aligned with a centerline of the first right bore hole/opening 82 to receive screws to fasten a first right top/bottom connector 90 (shown for example in FIG. 7 discussed below) to the bottom right support 18. In a specific embodiment, the bottom right support 18 may include openings 88 aligned with a centerline of the second right bore hole/opening 84 to receive screws to fasten a second right top/bottom connector 92 (shown for example in FIG. 7 discussed below) to the bottom right support 18. The function of the first right top/bottom connector 90 and the second right top/bottom connector 92 is described below.

Figure 4:
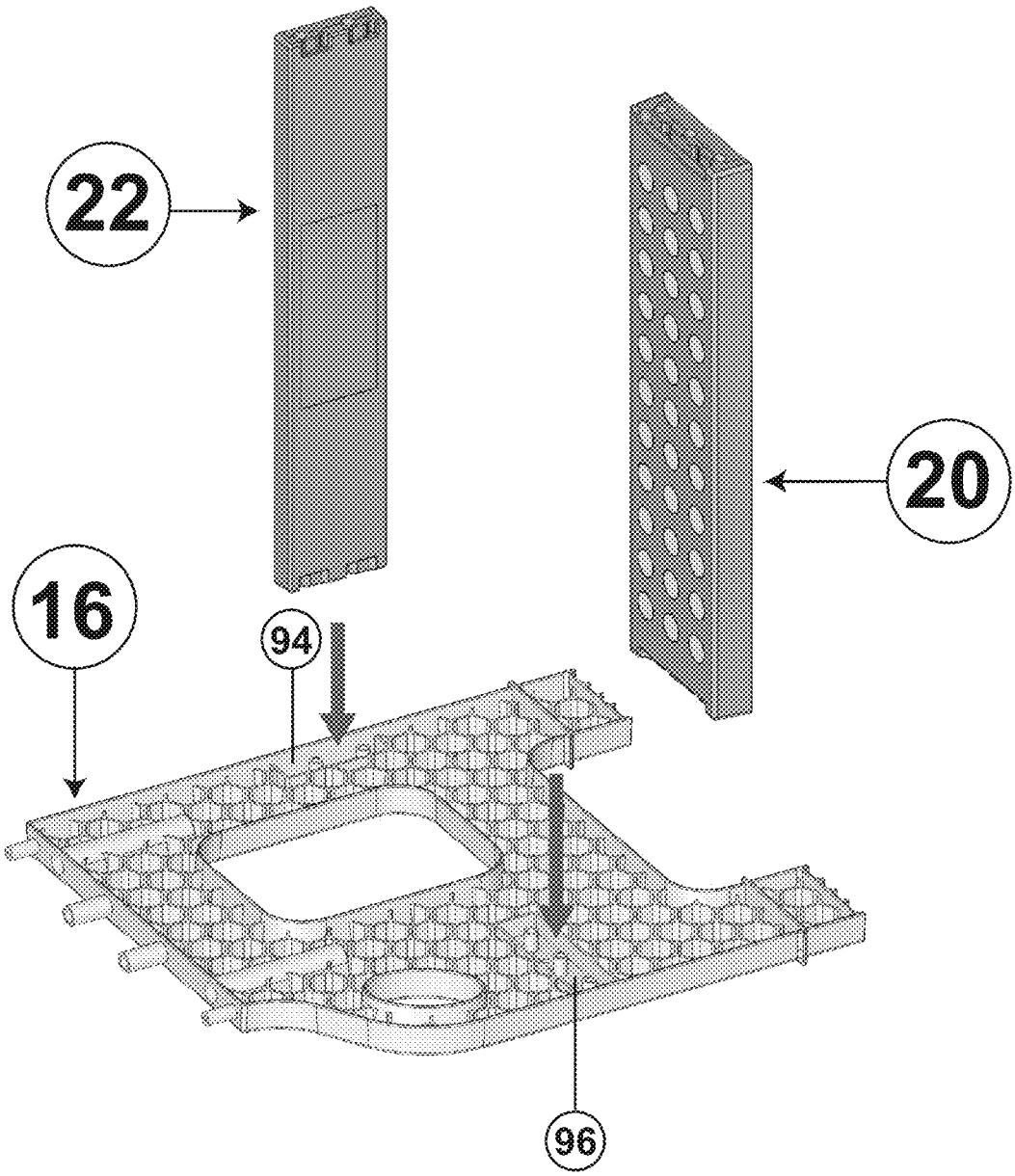
FIG. 4 is a perspective view showing a specific embodiment of various components of a step stool being assembled in accordance with the present inventions.
Figure 5:
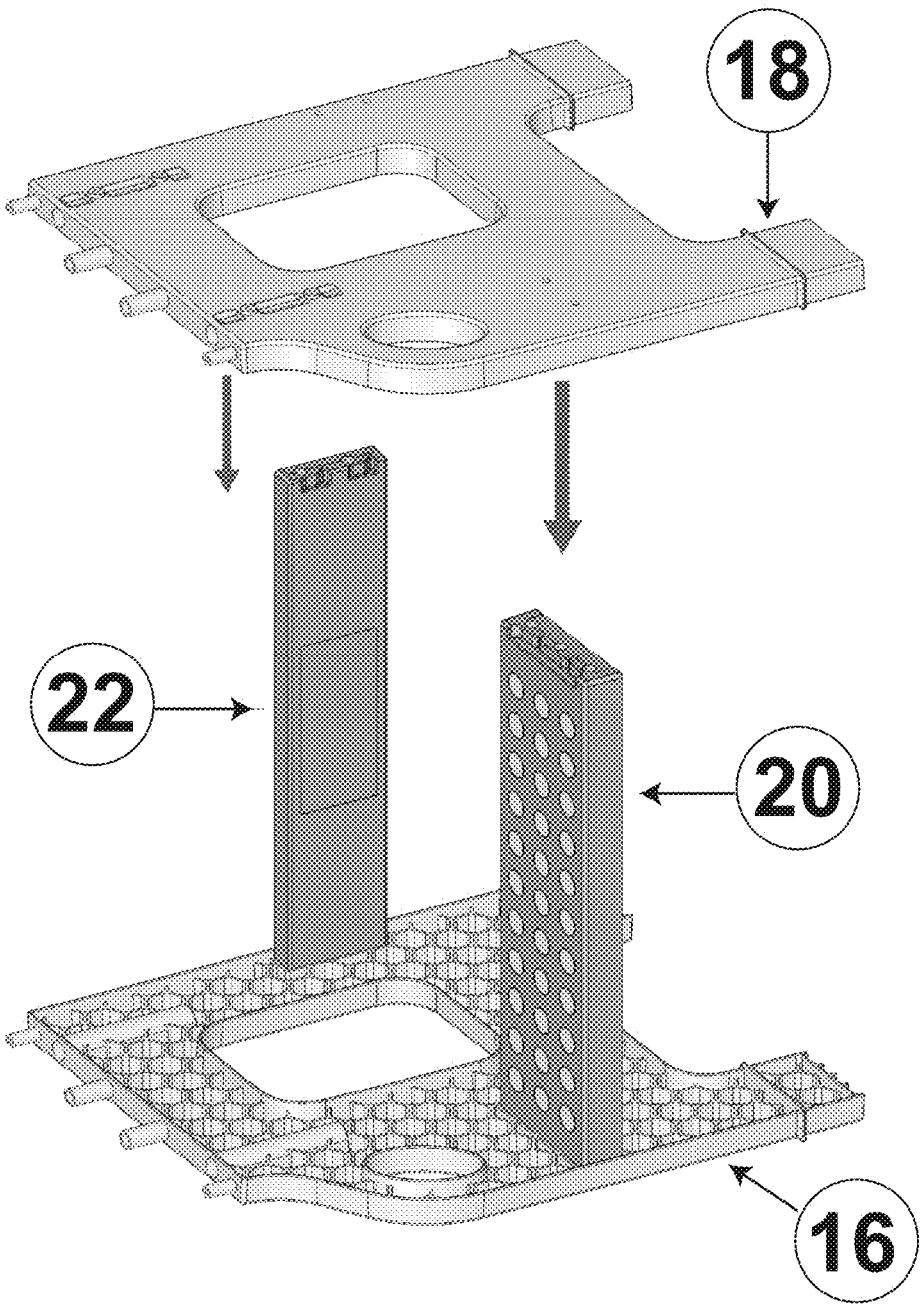
FIG. 5 is a perspective view showing a specific embodiment of various components of a step stool being assembled in accordance with the present inventions.

Referring now to FIG. 4, the process of assembling the bottom section 12 may be commenced by attaching the step base 20 and the bottom back support 22 to the bottom left support 16. The bottom left support 16 may be positioned down flat on a soft surface with its inner side facing up. The bottom back support 22 may be inserted into a back slot 94 on the inner side of the bottom left support 16, and the step base 20 may be inserted into a front slot 96 on the inner side of the bottom left support 16. With reference to FIG. 5, the lower right support 18 is lowered down and connected to the step base 20 and the bottom back support 22 in the same manner as discussed above.

Figure 6:
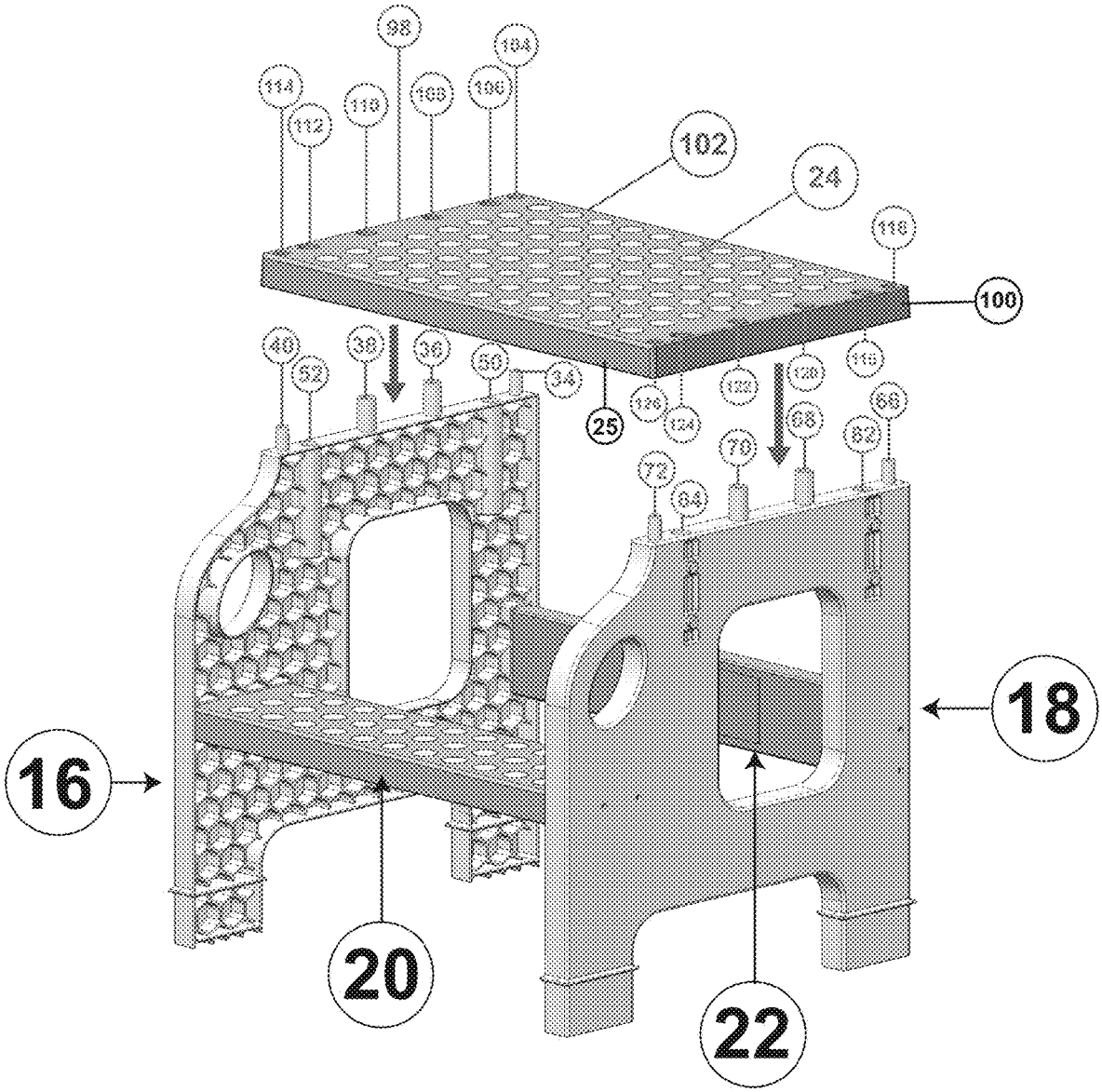
FIG. 6 is a perspective view showing a specific embodiment of various components of a step stool being assembled in accordance with the present inventions.

Next, as shown in FIG. 6, the assembly is moved into an upright position and the stand base 24 is lowered down into engagement with the bottom left support 16 and the bottom right support 18. FIG. 6 illustrates that the stand base 24 is provided with a plurality of openings along a left edge 98 of the stand base 24 and a plurality of openings along a right edge 100 of the stand base 24. In a specific embodiment, along the left edge 98 of the stand base 24, and moving from a rear edge 102 of the stand base 24 toward the front edge 25 of the stand base 24, the stand base 24 may include a first left opening 104, a second left opening 106, a third left opening 108, a fourth left opening 110, a fifth left opening 112, and a sixth left opening 114. In a specific embodiment, the cross-sectional profile of the left openings 104-114 may be of any shape, such as circular, square, hexagonal, for example, or any other shape. In a specific embodiment, the first left opening 104 may mate and engage with the first left upstanding connector 34 on the bottom left support 16; the third left opening 108 may mate and engage with the second left upstanding connector 36 on the bottom left support 16; the fourth left opening 110 may mate and engage with the third left upstanding connector 38 on the bottom left support 16; and the sixth left opening 114 may mate and engage with the fourth left upstanding connector 40 on the bottom left support 16. In a specific embodiment, the second left opening 106 may be aligned with the first left bore hole/opening 50 in the top edge 17 of the bottom left support 16, and the fifth left opening 112 may be aligned with the second left bore hole/opening 52 in the top edge 17 of the bottom left support 16.

Now referring to the right side 100 of the stand base 24 as shown in FIG. 6, in a specific embodiment, along the right edge 100 of the stand base 24, and moving from the rear edge 102 of the stand base 24 toward the front edge 25 of the stand base 24, the stand base 24 may include a first right opening 116, a second right opening 118, a third right opening 120, a fourth right opening 122, a fifth right opening 124, and a sixth right opening 126. In a specific embodiment, the cross-sectional profile of the right openings 116-126 may be of any shape, such as circular, square, hexagonal, for example, or any other shape. In a specific embodiment, the first right opening 116 may mate and engage with the first right upstanding connector 66 on the bottom right support 16; the third right opening 120 may mate and engage with the second right upstanding connector 68 on the bottom right support 16; the fourth right opening 122 may mate and engage with the third right upstanding connector 70 on the bottom right support 16; and the sixth right opening 126 may mate and engage with the fourth right upstanding connector 72 on the bottom right support 16. In a specific embodiment, the second right opening 118 may be aligned with the first right bore hole/opening 82 in the top edge 19 of the bottom right support 18, and the fifth right opening 124 may be aligned with the second right bore hole/opening 84 in the top edge 19 of the bottom right support 18.

At this point, a specific embodiment of a bottom section 12 in accordance with the present inventions has been initially assembled (screws will be added to as discussed below) and comprises a two-step step stool.

Figure 7:
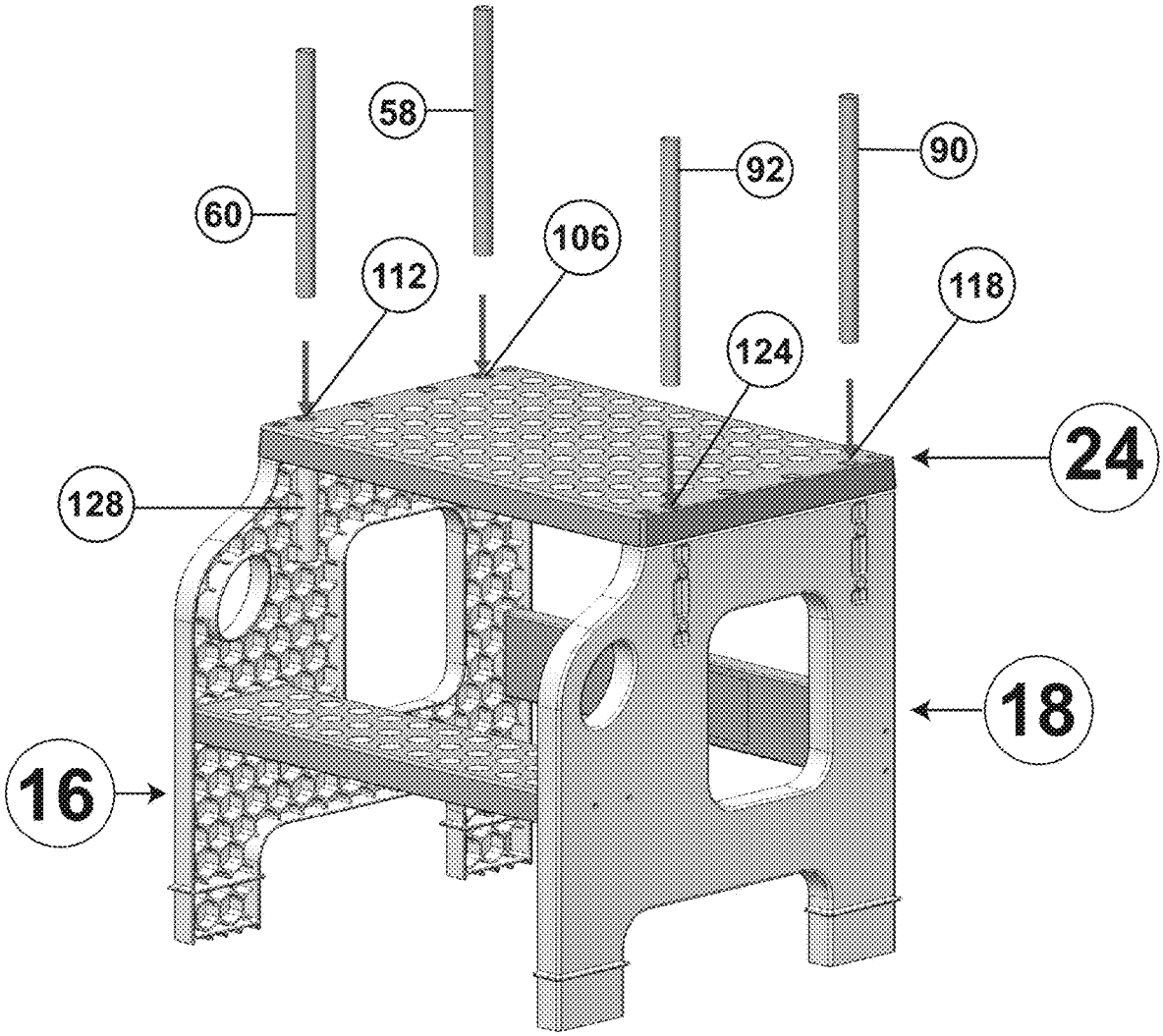
FIG. 7 is a perspective view of a specific embodiment of a bottom section assembled in accordance with the present inventions, and showing a plurality of top/bottom connectors being engaged with the bottom section.
Figure 8:
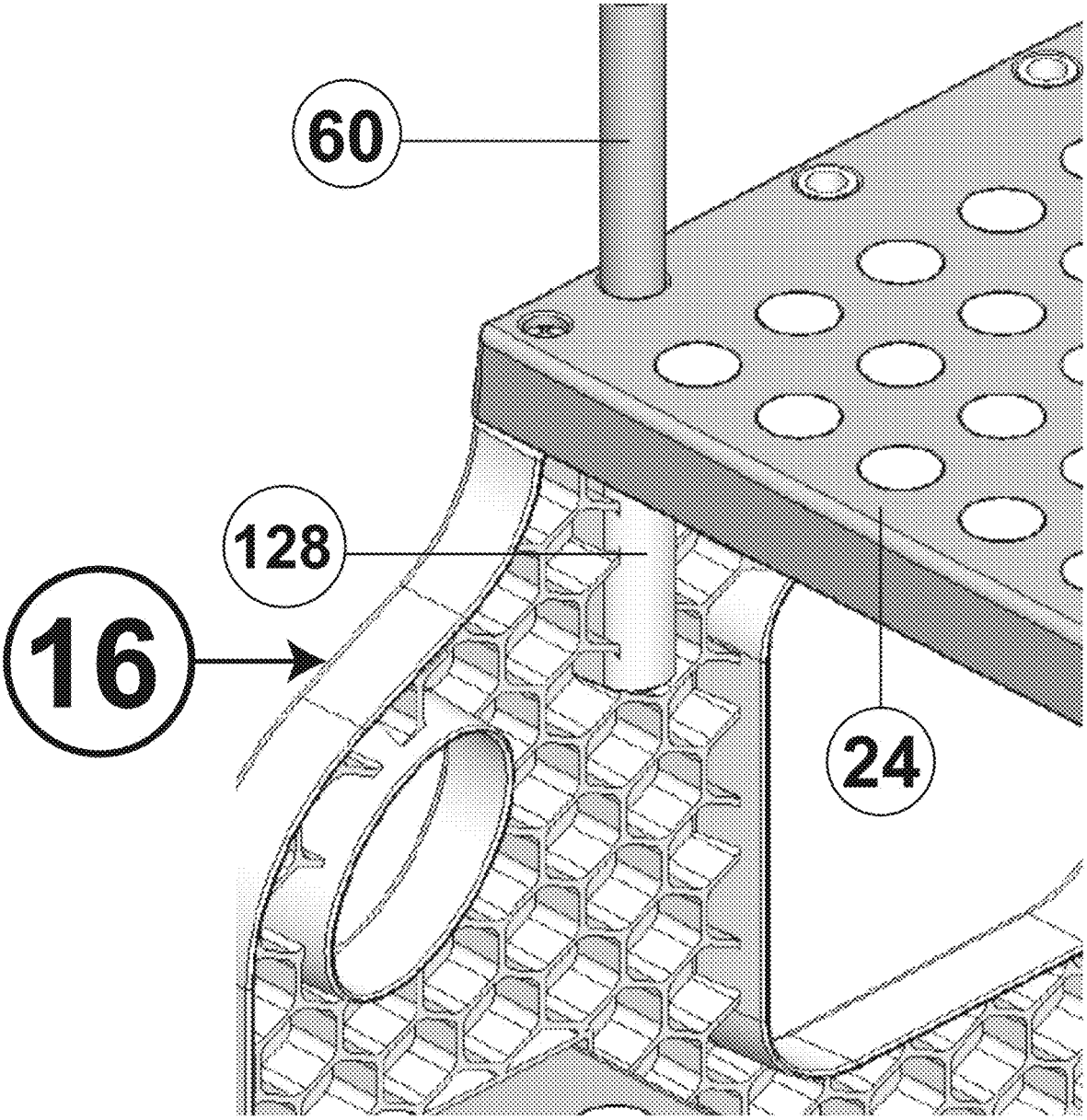
FIG. 8 is a perspective view of a portion of a specific embodiment of a bottom section assembled in accordance with the present inventions.

Referring now to FIG. 7, to proceed with attaching the top section 14 to the bottom section 16, the first left top/bottom connector 58 is inserted through the second left opening 106 in the stand base 24 and into the first left bore hole/opening 50 at the top edge 17 of the bottom left support 16 until the first left top/bottom connector 58 bottoms out on a bottom of the first left bore hole/opening 50, and the second left top/bottom connector 60 is inserted through the fifth left opening 112 in the stand base 24 and into the second left bore hole/opening 52 at the top edge 17 of the bottom left support 16 until the second left top/bottom connector 60 bottoms out on a bottom of the second left bore hole/opening 52. FIG. 7 illustrates part of an outer side wall 128 that forms or houses the second left bore hole/opening 52. This is further illustrated in FIG. 8, which also shows the second left top/bottom connector 60 extending above the top of the stand base 24 after it has been installed.

Still referring to FIG. 7, and turning to the right side of the stand base 24, the first right top/bottom connector 90 is inserted through the second right opening 118 in the stand base 24 and into the first right bore hole/opening 82 at the top edge 19 of the bottom right support 18 until the first right top/bottom connector 90 bottoms out on a bottom of the first right bore hole/opening 82, and the second right top/bottom connector 92 is inserted through the fifth right opening 124 in the stand base 24 and into the second right bore hole/opening 84 at the top edge 19 of the bottom right support 18 until the second right top/bottom connector 92 bottoms out on a bottom of the second right bore hole/opening 84.

Figure 21:
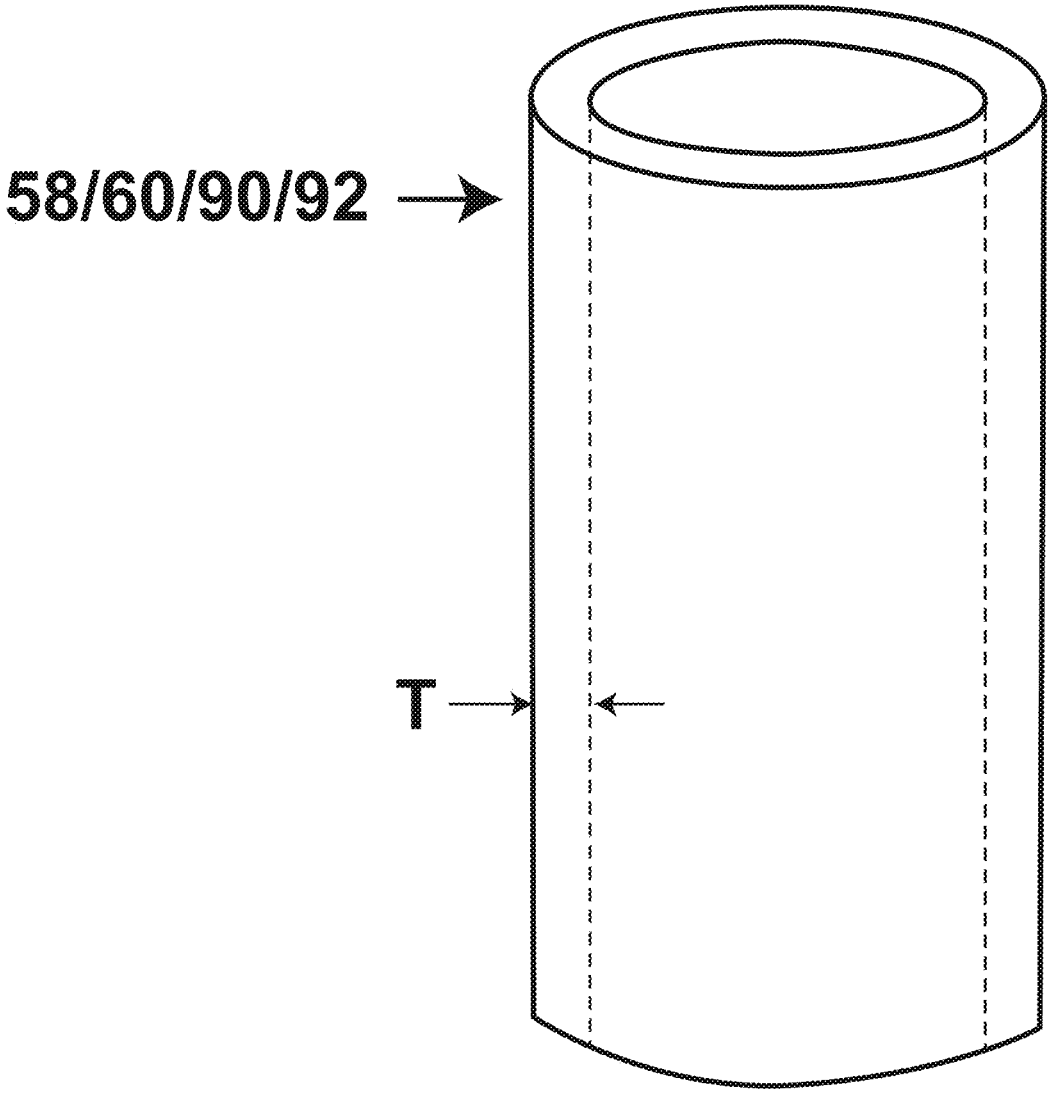
FIG. 21 is a perspective view of a cylindrical top/bottom connector that may form part of a specific embodiment of a step stool constructed according to the present inventions.

The top/bottom connectors 58, 60, 90 and 92 may be provided in any size or shape. In a specific embodiment, the top/bottom connectors 58, 60, 90 and 92 may by cylinders. In a specific embodiment, as shown in FIG. 21, the top/bottom connectors 58, 60, 90 and 92 may be cylinders made from aluminum and having sidewalls having a thickness T of 0.05 inches. In another specific embodiment, the top/bottom connectors 58, 60, 90 and 92 may be solid cylindrical rods. In another specific embodiment, the top/bottom connectors 58, 60, 90 and 92 may be of some other cross-sectional shape, such as square or hexagonal, for example.

Figure 9:
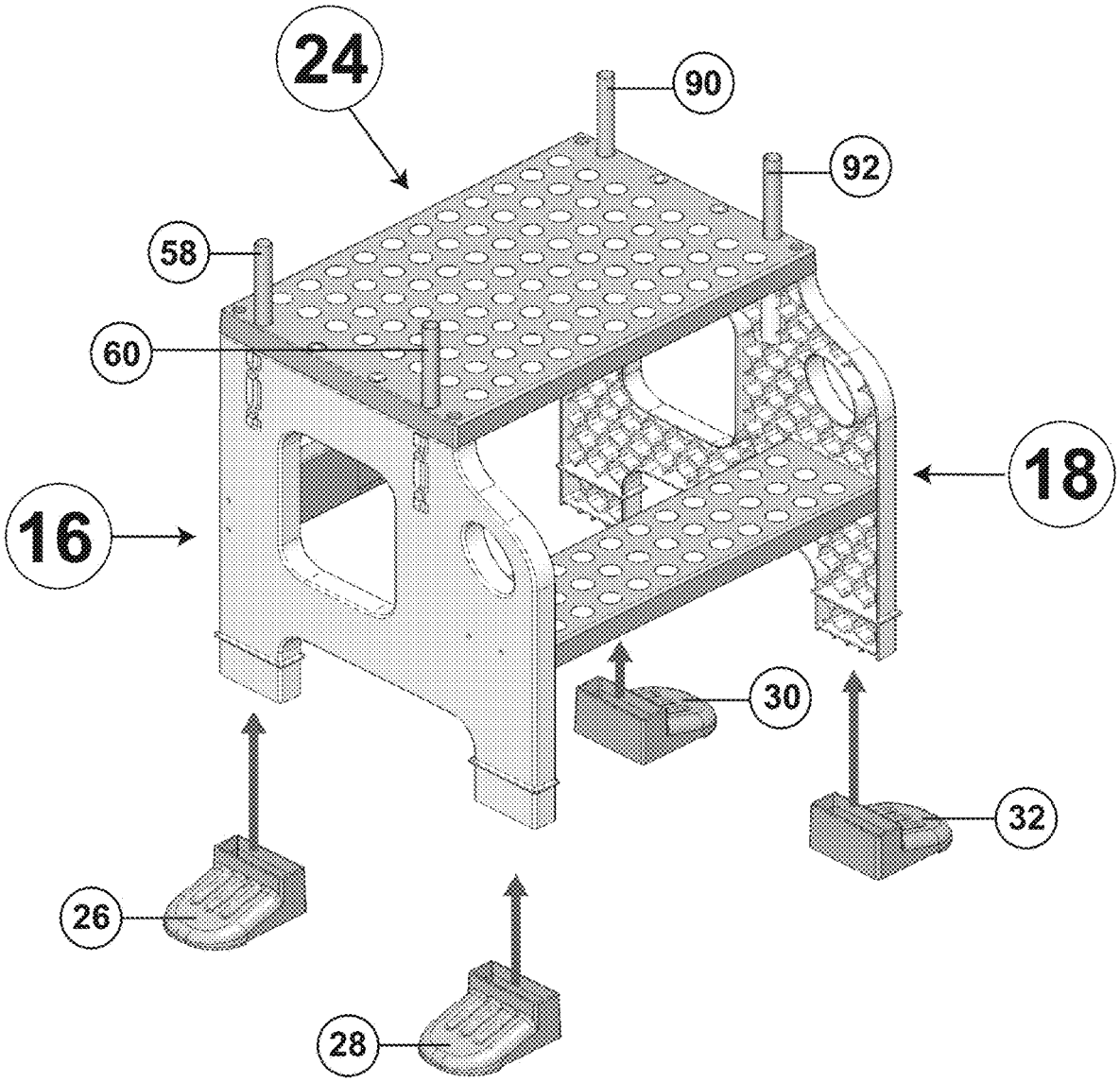
FIG. 9 is a perspective view of a plurality of feet being connected to a specific embodiment of a bottom section assembled in accordance with the present inventions.
Figure 10:
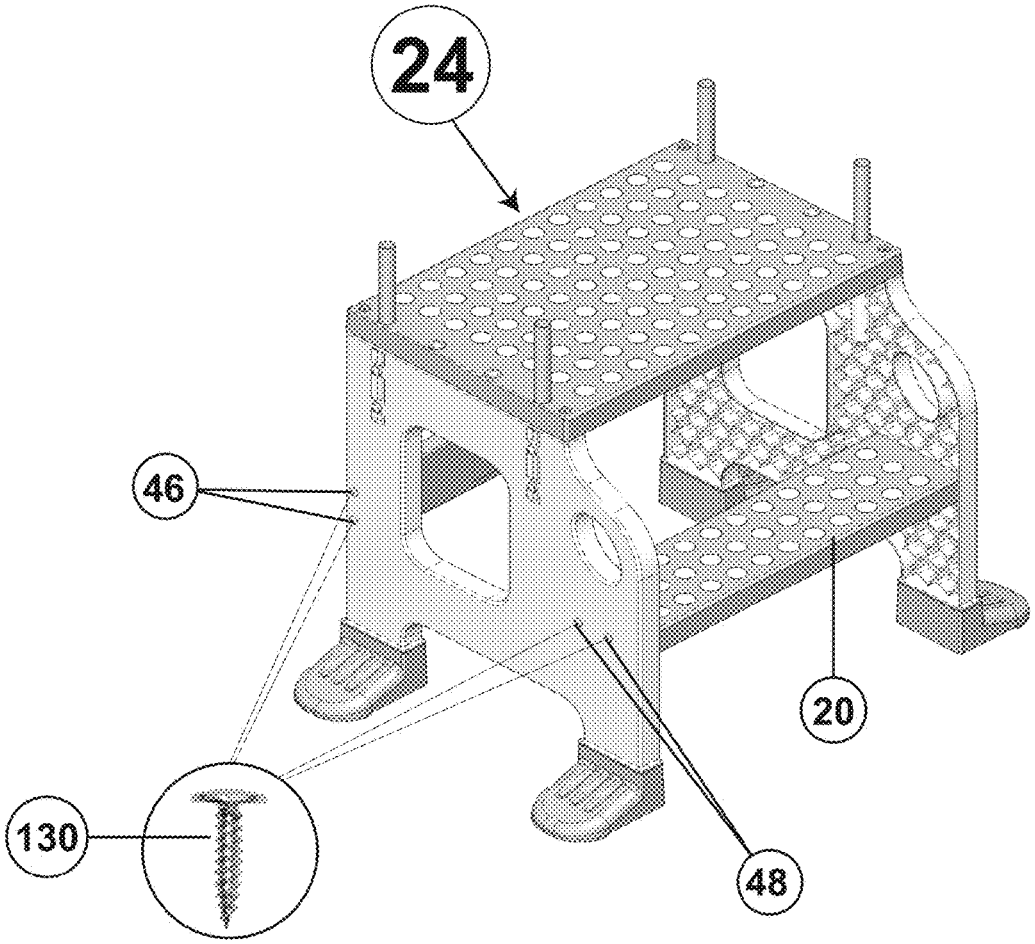
FIG. 10 is a perspective view showing screws being used to securely fasten portions of a specific embodiment of a bottom section assembled in accordance with the present inventions.
Figure 11:
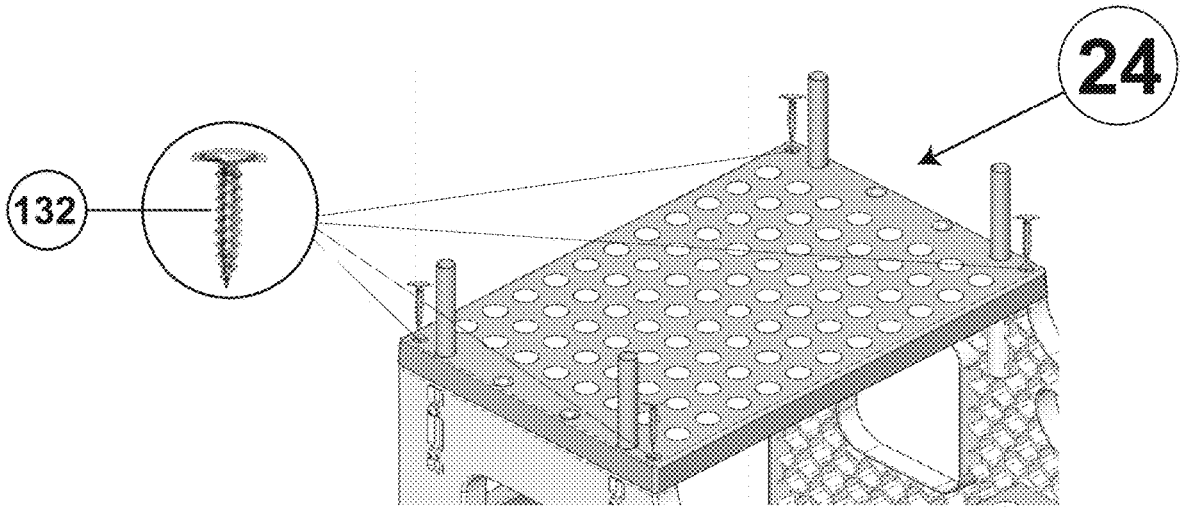
FIG. 11 is a perspective view showing screws being used to securely fasten a stand base to a bottom left support and a bottom right support included as part of a specific embodiment of a bottom section assembled in accordance with the present inventions.

Referring now to FIG. 9, the top/bottom connectors 58, 60, 90 and 92 are shown fully inserted into their corresponding bore holes/openings 50, 52, 82, and 84, with their upper portions extending upwardly away from the stand base 24. FIG. 9 further illustrates the manner in which the feet 26-30 may be attached to the lower left support 16 and the lower right support 18. With reference to FIG. 10, screws 130 are installed through openings 46 and 48 to securely fasten the bottom left support 16 to the stop base 20 and the bottom back support 22. The same is done on the opposite side with respect to the bottom right support 18. As shown in FIG. 11, screws 132 are installed through the first left opening 104, sixth left opening 114, first right opening 116, and sixth right opening 126 to securely fasten the stand base 24 to the lower left support 16 and lower right support 18. In a specific embodiment, during assembly, the screws may preferably not be completely tightened at this point.

The details of the top section 14 will now be described. With reference to FIG. 1, in a specific embodiment, the top section 14 may include a top left support 134, a top right support 136, a top back support 138 and a cross bar 140. In a specific embodiment, the top left support 134 and the top right support 136 may be positioned in generally vertical planes that are spaced apart from and generally parallel to each other. In a specific embodiment, the cross bar 140 may be attached to and between front sides of the top left support 134 and the top right support 136 in a generally horizontal plane. In a specific embodiment, the top back support 138 may be attached to and between rear sides of the top left support 134 and the top right support 136 in a generally vertical plane.

Figure 12:
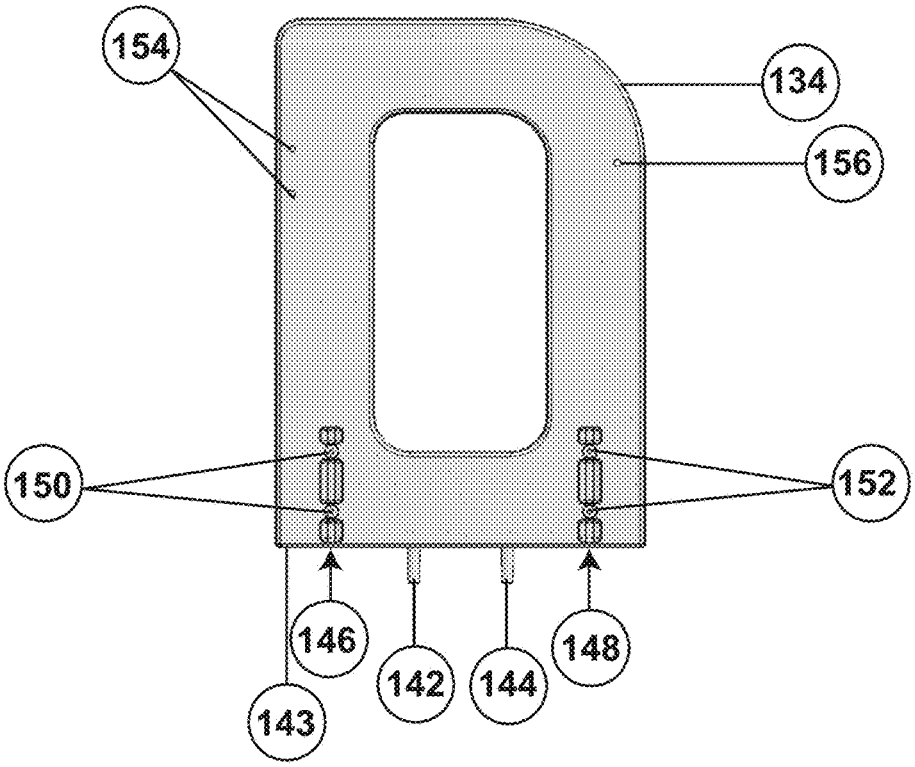
FIG. 12 is a side view of a top left support that forms part of a specific embodiment of an improved step stool in accordance with the present inventions.

FIG. 12 shows a side view of a specific embodiment of the top left support 134. In a specific embodiment, the top left support 134 may include a first left downwardly extending connector 142 extending from a lower edge 143 of the top left support 134, and a second left downwardly extending connector 144 extending from the lower edge 143 of the top left support 134. In a specific embodiment, the top left support 134 may further include a first upper left bore hole or opening 146 extending upwardly from the lower edge 143 and within the top left support 134, and a second upper left bore hole or opening 148 extending upwardly from the lower edge 143 and within the top left support 134.

FIG. 12 also shows that, in a specific embodiment, the top left support 134 may include openings 150 aligned with a centerline of the first upper left bore hole/opening 146 to receive screws to fasten the first left top/bottom connector 58 (discussed above) to the top left support 134. In a specific embodiment, the top left support 134 may include openings 152 aligned with a centerline of the second upper left bore hole/opening 148 to receive screws to fasten the second left top/bottom connector 60 (discussed above) to the top left support 134. FIG. 12 also shows that, in a specific embodiment, the top left support 134 may include openings 154 to receive screws to fasten the top left support 134 to the top back support 138. In a specific embodiment, the top left support 134 may also include an opening 156 to receive a screw to fasten the top left support 134 to the cross bar 140.

Figure 13:
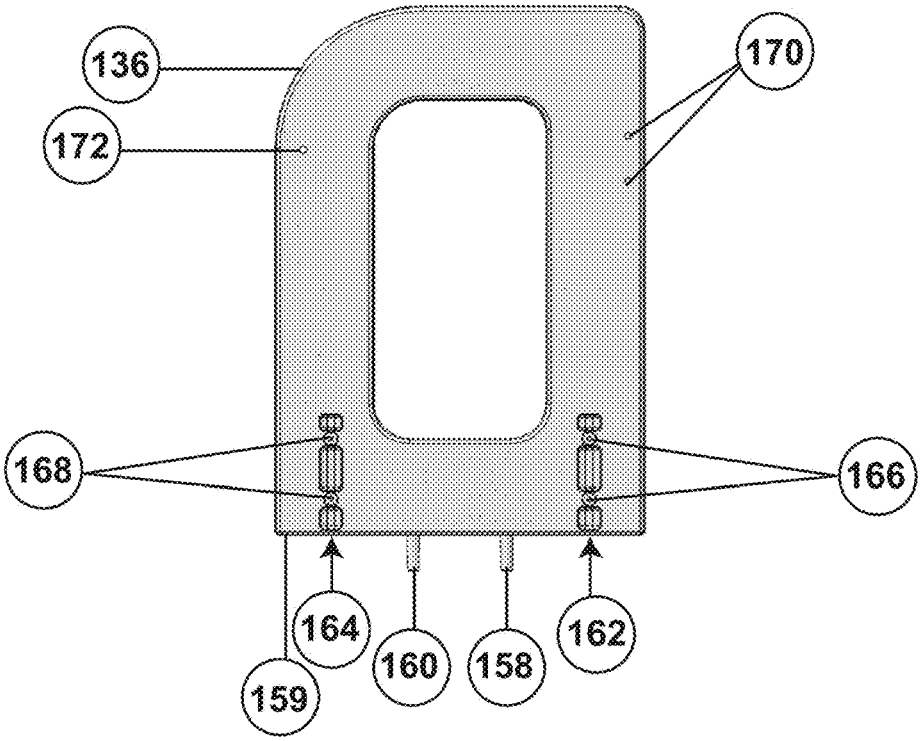
FIG. 13 is a side view of a top right support that forms part of a specific embodiment of an improved step stool in accordance with the present inventions.

FIG. 13 shows a side view of a specific embodiment of the top right support 136. In a specific embodiment, the top right support 136 may include a first right downwardly extending connector 158 extending from a lower edge 159 of the top right support 136, and a second right downwardly extending connector 160 extending from the lower edge 159 of the top right support 136. In a specific embodiment, the top right support 136 may further include a first upper right bore hole or opening 162 extending upwardly from the lower edge 159 and within the top right support 136, and a second upper right bore hole or opening 164 extending upwardly from the lower edge 159 and within the top left support 136.

FIG. 13 also shows that, in a specific embodiment, the top right support 136 may include openings 166 aligned with a centerline of the first upper right bore hole/opening 162 to receive screws to fasten the first right top/bottom connector 90 (discussed above) to the top right support 136. In a specific embodiment, the top right support 136 may include openings 168 aligned with a centerline of the second upper right bore hole/opening 164 to receive screws to fasten the second right top/bottom connector 92 (discussed above) to the top right support 136. FIG. 13 also shows that, in a specific embodiment, the top right support 136 may include openings 170 to receive screws to fasten the top right support 136 to the top back support 138. In a specific embodiment, the top right support 136 may also include an opening 172 to receive a screw to fasten the top right support 136 to the cross bar 140.

In a specific embodiment, the size and shape of the bore holes/openings 146, 148, 162, and 164 may be the same as for the bore holes/openings 50, 52, 82, and 84 discussed above. Similarly, the size and shape of the downwardly extending connectors 142, 144, 158, and 160 may be the same as for the upstanding connectors 36, 38, 68, and 70 as discussed above. In a specific embodiment, the upstanding connectors 36, 38, 68, and 70 may be adapted to receive and engage with the downwardly extending connectors 142, 144, 158, and 160, or vice versa. In a specific embodiment, the upper ends of the upstanding connectors 36, 38, 68, and 70 may be include bore holes or openings adapted to receive and engage with the downwardly extending connectors 142, 144, 158, and 160.

Figure 14:
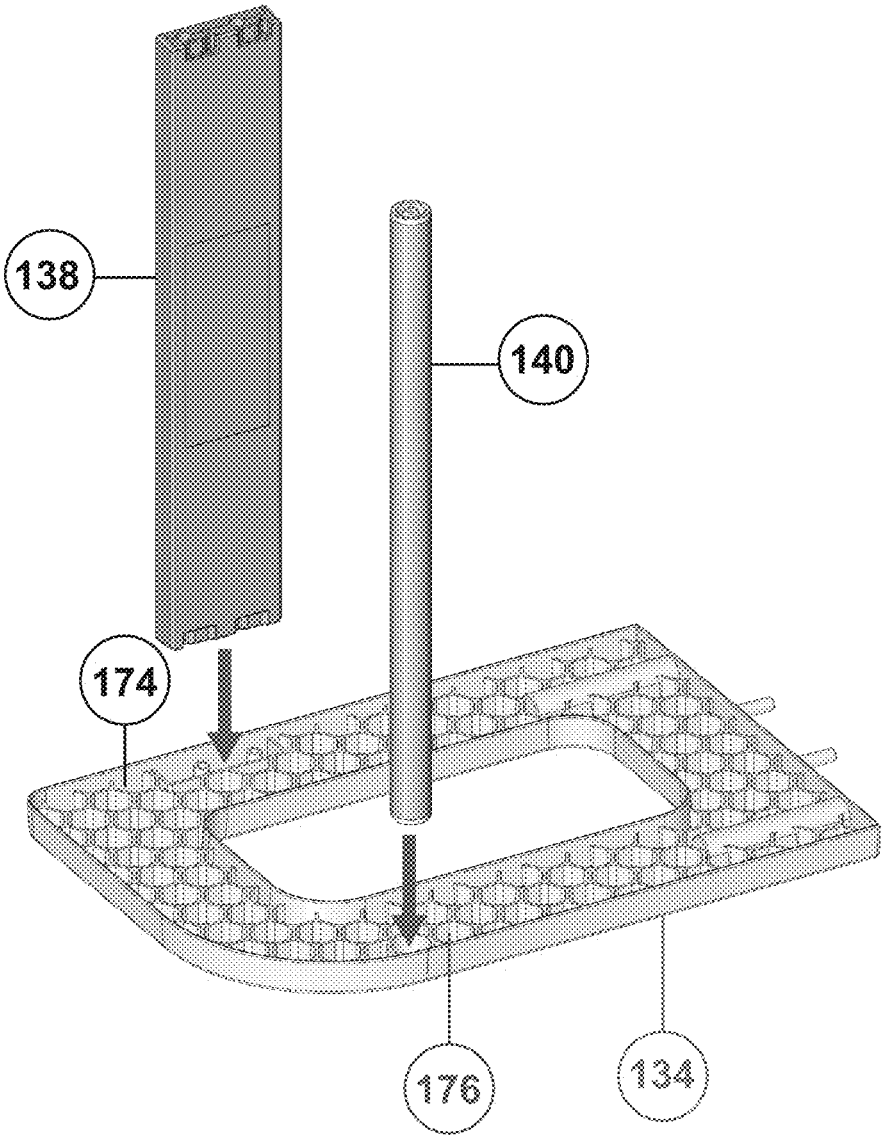
FIG. 14 is a perspective view showing a specific embodiment of a top section of a step stool in the process of being assembled in accordance with the present inventions.
Figure 15:
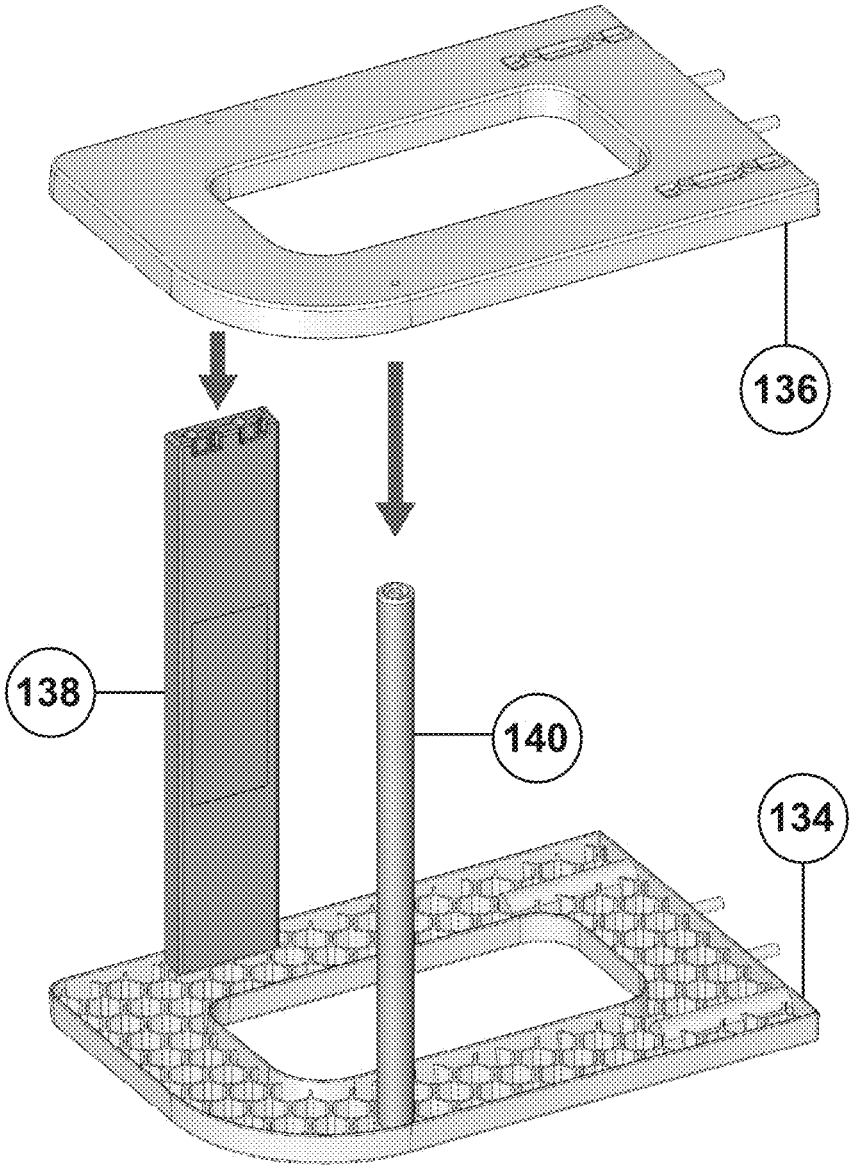
FIG. 15 is a perspective view similar to FIG. 14 showing a specific embodiment of a top section of a step stool in the process of being assembled in accordance with the present inventions.

Referring now to FIG. 14, the process of assembling the top section 14 may be commenced by attaching the top back support 138 and the cross bar 140 to the top left support 134. The top left support 134 may be positioned down flat on a soft surface with an inner side of the top left support 134 facing up. The top back support 138 may be inserted into a back slot 174 on the inner side of the top left support 134, and the cross bar 140 may be inserted into a front slot 176 on the inner side of the top left support 134. With reference to FIG. 15, the top right support 136 is lowered down and connected to the top back support 138 and the cross bar 140 in the same manner as discussed above.

Figure 16:
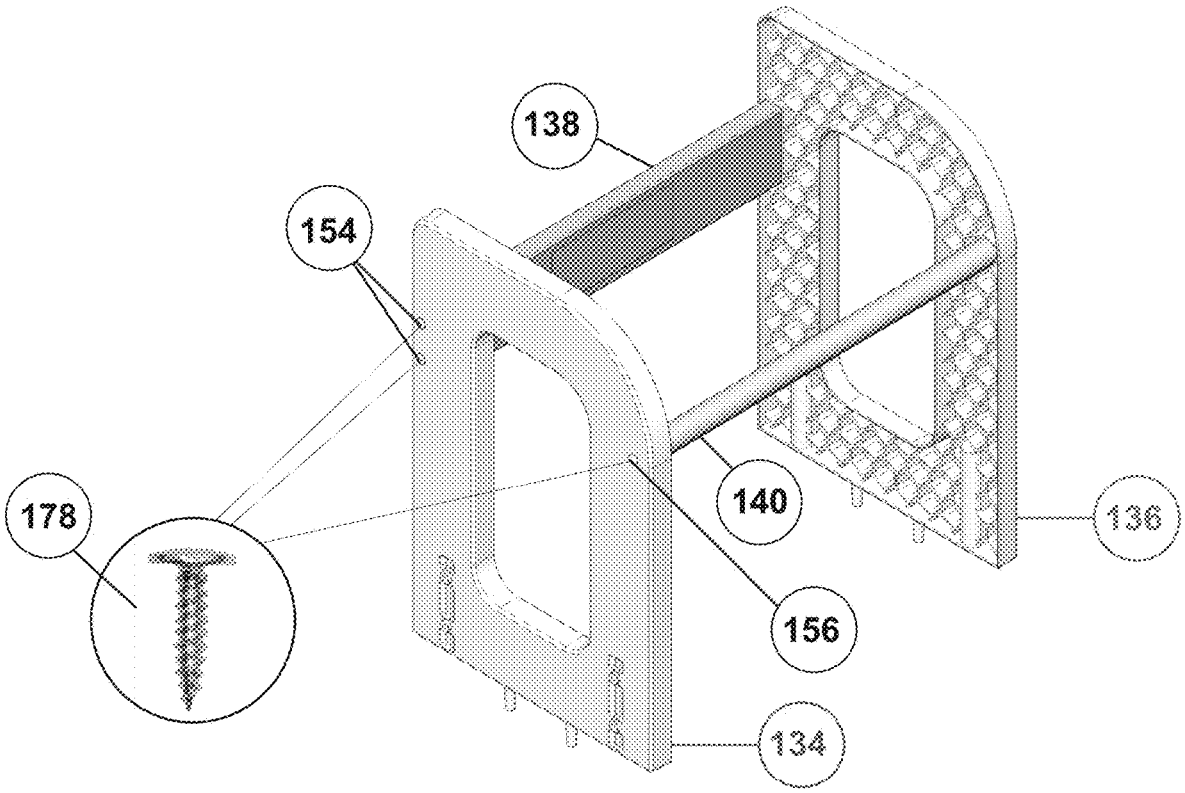
FIG. 16 is a perspective view showing a specific embodiment of a top section of a step stool that has been assembled in accordance with the present inventions.

With reference to FIG. 16, screws 178 are installed through openings 154 and 156 to securely fasten the top left support 134 to the top back support 138 and the cross bar 140. The same is done on the opposite side with respect to the top right support 136. In a specific embodiment, during assembly, the screws may preferably not be completely tightened at this point.

Figure 17:
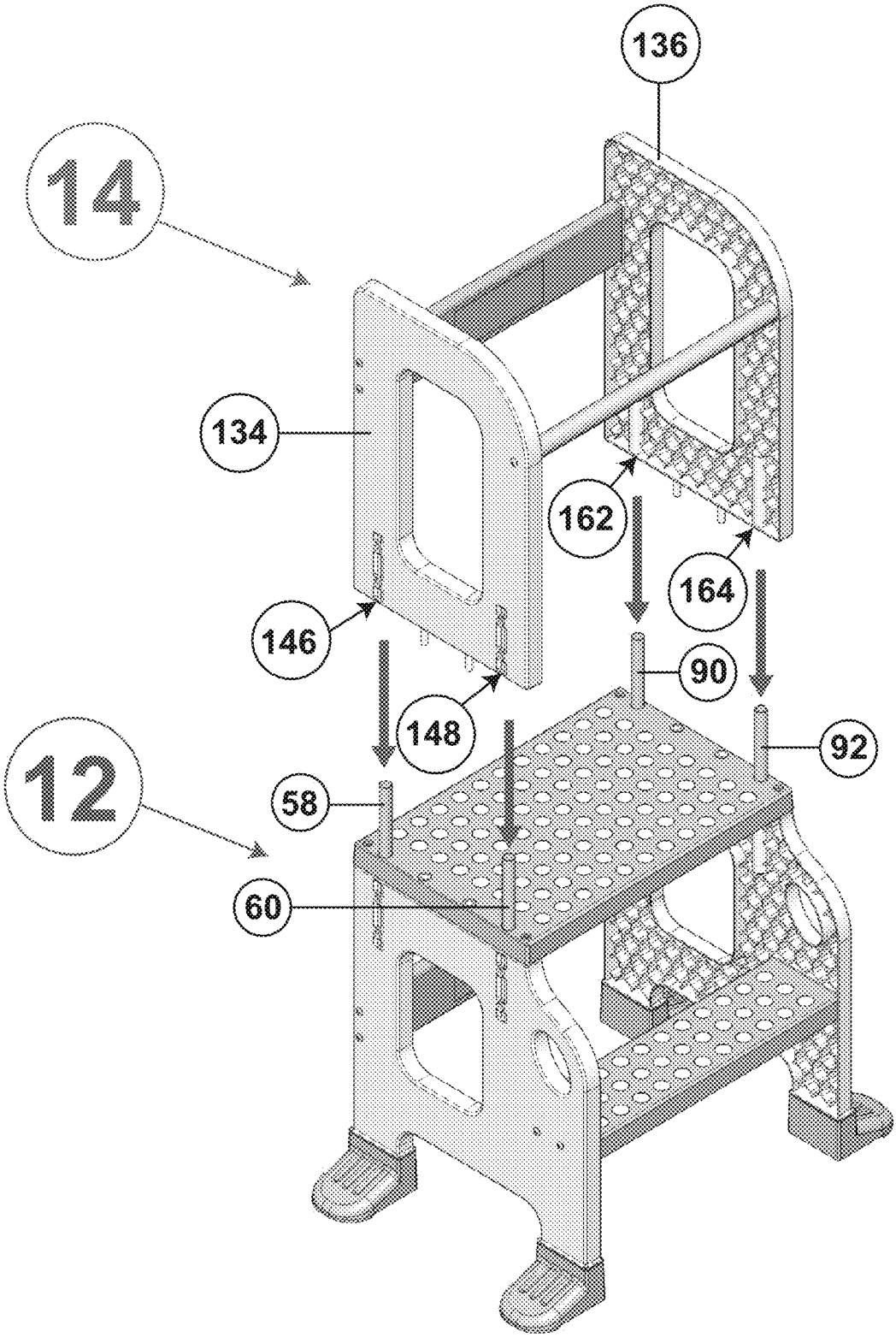
FIG. 17 is a perspective view showing a specific embodiment of a top section of a step stool being attached to a specific embodiment of a bottom section of the step stool in accordance with the present inventions.
Figure 18:
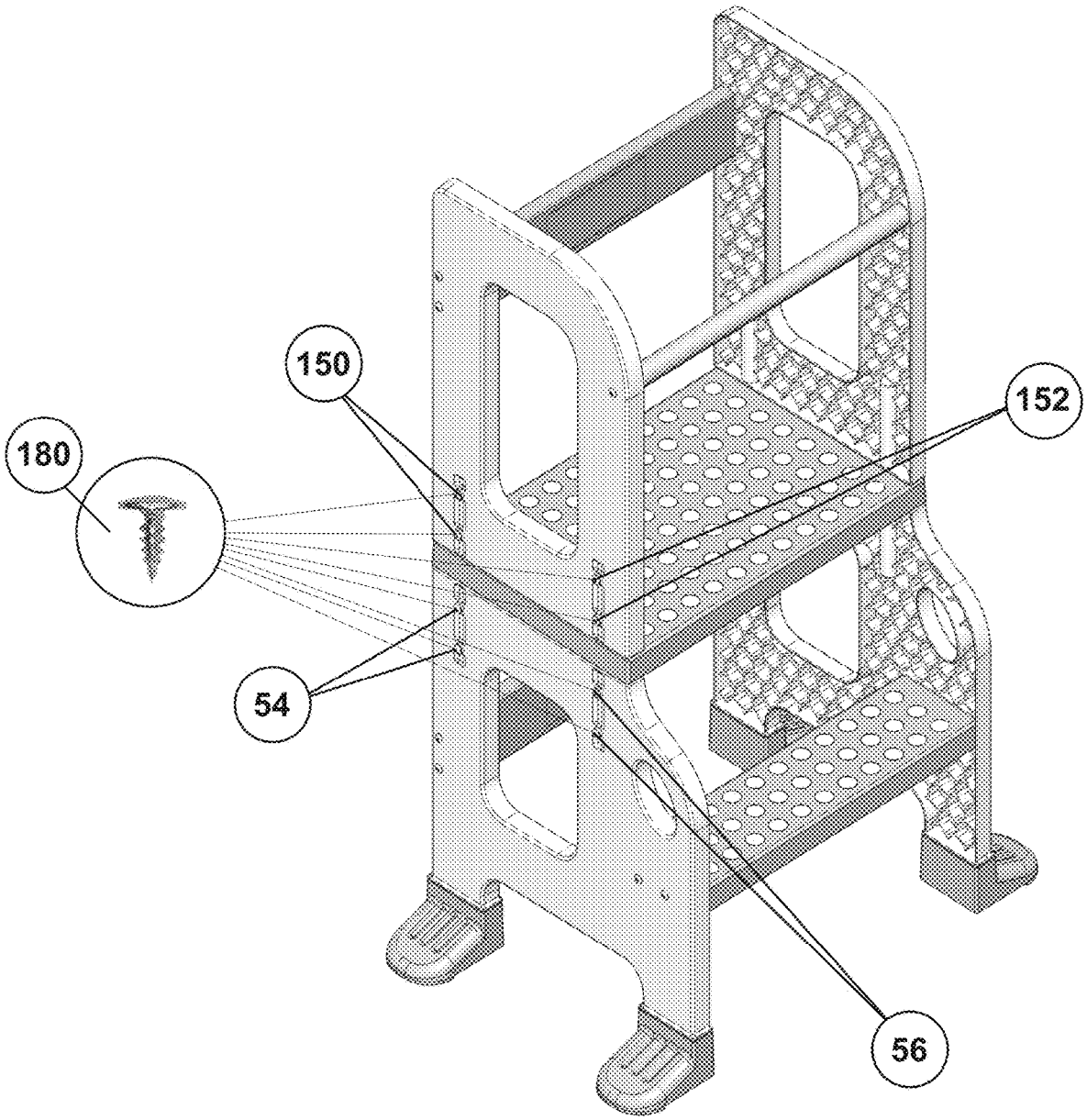
FIG. 18 is a perspective view of a step stool in accordance with the present invention, and in the process of a plurality of screws being installed to secure a top section and a bottom section of the step stool in accordance with the present inventions.

Next, as shown in FIG. 17, the top section 14 is lowered down into engagement with the bottom section 12. In a specific embodiment, the first upper left bore hole/opening 146 on the top left support 134 is pushed into engagement with the first left top/bottom connector 58; the second upper left bore hole/opening 148 on the top left support 134 is pushed into engagement with the second left top/bottom connector 60; the first upper right bore hole/opening 162 on the top right support 136 is pushed into engagement with the first right top/bottom connector 90; and the second upper right bore hole/opening 164 on the top right support 136 is pushed into engagement with the second right top/bottom connector 92. FIG. 18 shows the top section 14 engaged with the bottom section 12. At this point, in a specific embodiment, the screws 180 are installed in the openings 54, 56, 150, and 152, and then all screws that have been installed thus far can be tightened. This is also done on the right side of the step stool 10 in the same manner. In a specific embodiment, the screws 180 may be provided with a length such that a pointed tip of the screws 180 will pierce the top/bottom connectors 58, 60, 90, and 92 when the screws 180 are fully inserted. In this regard, in a specific embodiment, the top/bottom connectors 58, 60, 90, and 92 are not provided with holes that must be lined up with the screws 180.

Figure 19:
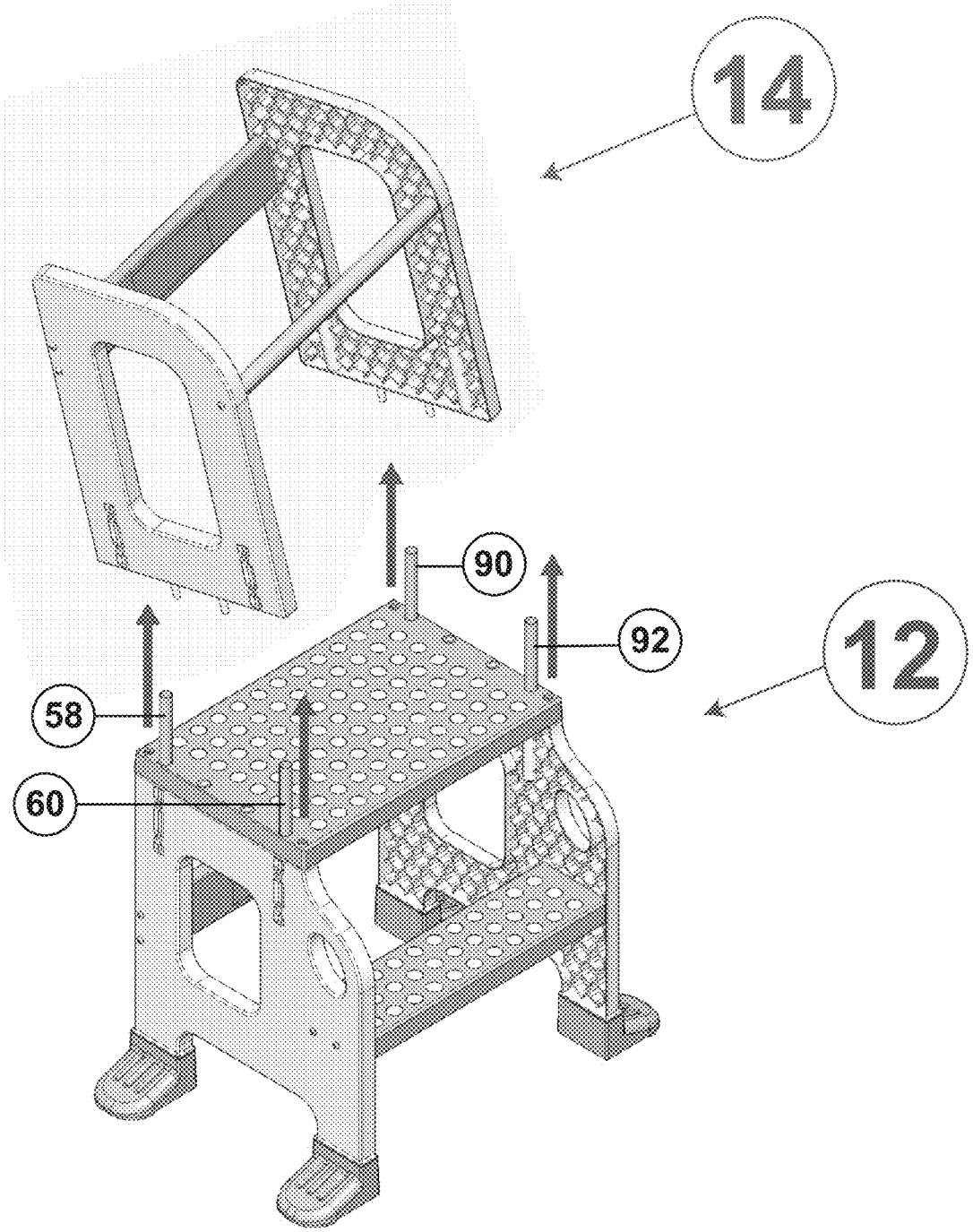
FIG. 19 is a perspective view showing a specific embodiment of a top section of a step stool being detached from a specific embodiment of a bottom section in accordance with the present inventions.
Figure 20:
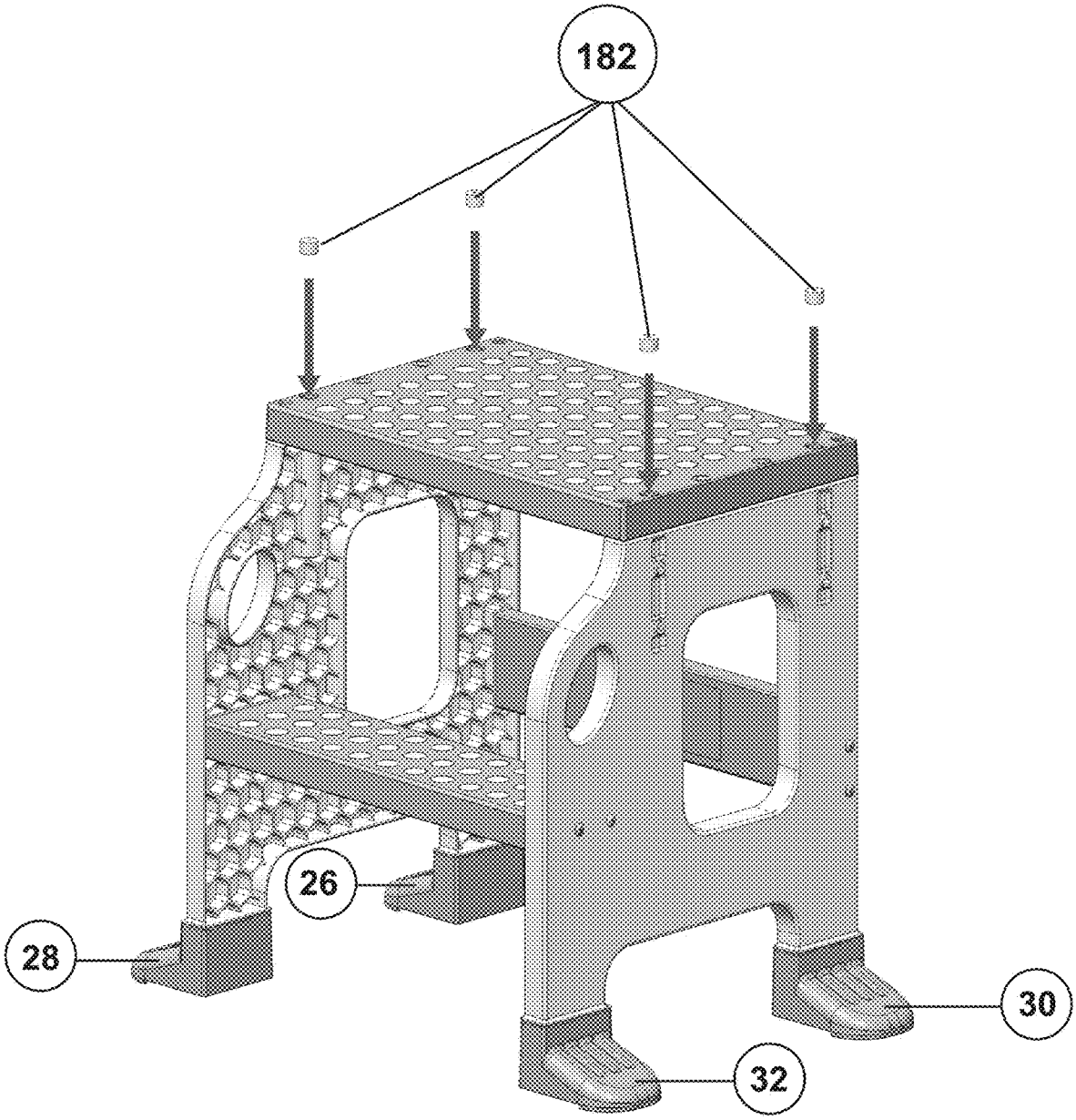
FIG. 20 is a perspective view showing a specific embodiment of a bottom section of a step stool after a top section has been detached therefrom, and in the process of buttons being inserted into empty holes in the top of the bottom section where top/bottom connectors had previously been installed.

Once the step stool 10 is assembled, it may be used for a variety of purposes. For example, in a specific embodiment, it may be used by children to enable them to access surfaces beyond their reach, such as table tops or counter tops, such as located in a kitchen. With the assistance of an adult, a child may climb up and stand on the stand base 24, in which case the cross bar 140 may function to assist the adult in preventing the child from falling off the stand base 24. In other situations, it may be desired to use the step stool 10 without the top section 14. One of the advantages of the present inventions is that the top section 14 can easily be detached from the bottom section 12. To do this, simply remove the screws 180 that were installed as shown in FIG. 18, and pull the top section 14 upwardly and away from the bottom section 12, as shown in FIG. 19. Next, the top/bottom connectors 58, 60, 90, and 92 are removed from the bottom section 12. As shown in FIG. 20, the empty openings may be filled with buttons 182.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims.

The invention claimed is:

1. An improved step stool comprising:

a bottom section;

a top section; and a plurality of top/bottom connectors;

the bottom section and the top section being removably attachable to one another;

the bottom section including a bottom left support, a bottom right support, a step base and a stand base, the bottom left support and the bottom right support being spaced apart and connected by the stand base and the step base, the stand base being attached to a top edge of the bottom left support and a top edge of the bottom right support, the step base being attached between the bottom left support and the bottom right support, the step base being disposed below the stand base, the bottom section including at least one left opening formed into the top edge of the bottom left support, the at least one left opening being adapted to receive a portion of one of the plurality of top/bottom connectors, the bottom section including at least one right opening formed into the top edge of the bottom right support, the at least one right opening being adapted to receive a portion of one of the plurality of top/bottom connectors; and the top section including a top left support, a top right support, and a lateral support, the top left support and the top right support being spaced apart and connected by the lateral support, the top section including at least one upper left opening extending upwardly into the top left support from a lower edge of the top left support, the at least one upper left opening being adapted to receive a portion of the top/bottom connector disposed in the at least one left opening formed through a left edge of the stand base and into the top edge of the bottom left support, the top section including at least one upper right opening extending upwardly into the top right support from a lower edge of the top right support, the at least one upper right opening being adapted to receive a portion of the top/bottom connector disposed in the at least one right opening.

2. The step stool of claim 1, further including a bottom back support connected between the bottom left support and the bottom right support.

3. The step stool of claim 1, wherein the lateral support is one of a top back support and a cross bar.

4. The step stool of claim 1, wherein each of the at least one left opening, the at least one right opening, the at least one upper left opening, and the at least one upper right opening is a cylindrical bore hole, and each of the plurality of top/bottom connectors is in the shape of a cylinder.

5. The step stool of claim 1, wherein each of the at least one left opening, the at least one right opening, the at least one upper left opening, and the at least one upper right opening is a cylindrical bore hole, and each of the plurality of top/bottom connectors is an aluminum cylinder.

6. The step stool of claim 5, wherein each aluminum cylinder has a wall thickness of 0.05 inches.

7. The step stool of claim 1, wherein:

the bottom left support includes at least one opening aligned with the at least one left opening and through which a fastener is installed to secure one of the plurality of top/bottom connectors to the bottom left support;

the bottom right support includes at least one opening aligned with the at least one right opening and through which a fastener is installed to secure one of the plurality of top/bottom connectors to the bottom right support;

the top left support includes at least one opening aligned with the at least one upper left opening and through which a fastener is installed to secure one of the plurality of top/bottom connectors to the top left support; and the top right support includes at least one opening aligned with the at least one upper right opening and through which a fastener is installed to secure one of the plurality of top/bottom connectors to the top right support.

8. The step stool of claim 1, wherein:

the bottom left support includes at least one left upstanding connector extending from the top edge of the bottom left support, the at least one left upstanding connector being adapted for engagement with at least one left opening adjacent the left edge of the stand base; and the bottom right support includes at least one right upstanding connector extending from the top edge of the bottom right support, the at least one right upstanding connector being adapted for engagement with at least one right opening adjacent a right edge of the stand base.

9. An improved step stool comprising:

a bottom section;

a top section;

a first left top/bottom connector;

a second left top/bottom connector;

a first right top/bottom connector; and a second right top/bottom connector;

the bottom section and the top section being removably attachable to one another;

the bottom section including a bottom left support, a bottom right support, a step base and a stand base, the bottom left support and the bottom right support being spaced apart and connected by the stand base and the step base, the stand base being attached to a top edge of the bottom left support and a top edge of the bottom right support, the step base being attached between the bottom left support and the bottom right support, the step base being disposed below the stand base;

the bottom section including a first left opening and a second left opening, the first left opening and the second left opening being formed into the top edge of the bottom left support, the first left opening being adapted to receive a portion of the first left top/bottom connector, and the second left opening being adapted to receive a portion of the second left top/bottom connector;

the bottom section including a first right opening and a second right opening, the first right opening and the second right opening being formed into the top edge of the bottom right support, the first right opening being adapted to receive a portion of the first right top/bottom connector, and the second left opening being adapted to receive a portion of the second right top/bottom connector;

the top section including a top left support, a top right support, and a lateral support, the top left support and the top right support being spaced apart and connected by the lateral support;

the top section including a first upper left opening extending upwardly into the top left support from a lower edge of the top left support, and a second upper left opening extending upwardly into the top left support from the lower edge of the top left support, the first upper left opening being adapted to receive a portion of the first left top/bottom connector, and the second upper left opening being adapted to receive a portion of the second left top/bottom connector; and the top section including a first upper right opening extending upwardly into the top right support from a lower edge of the top right support, and a second upper right opening extending upwardly into the top right support from the lower edge of the top right support, the first upper right opening being adapted to receive a portion of the first right top/bottom connector, and the second upper right opening being adapted to receive a portion of the second right top/bottom connector.

10. The step stool of claim 9, further including a bottom back support connected between the bottom left support and the bottom right support.

11. The step stool of claim 9, wherein the lateral support is one of a top back support and a cross bar.

12. The step stool of claim 9, wherein each of the first left opening, the second left opening, the first right opening, the second right opening, the first upper left opening, the second upper left opening, the first upper right opening, and the second upper right opening is a cylindrical bore hole, and each of the top/bottom connectors is in the shape of a cylinder.

13. The step stool of claim 9, wherein each of the first left opening, the second left opening, the first right opening, the second right opening, the first upper left opening, the second upper left opening, the first upper right opening, and the second upper right opening is a cylindrical bore hole, and each of the top/bottom connectors is an aluminum cylinder.

14. The step stool of claim 13, wherein each aluminum cylinder has a wall thickness of 0.05 inches.

15. The step stool of claim 9, wherein:

the bottom left support includes at least one opening aligned with the first left opening and through which a fastener is installed to secure the first left top/bottom connector to the bottom left support;

the bottom left support includes at least one opening aligned with the second left opening and through which a fastener is installed to secure the second left top/bottom connector to the bottom left support;

the bottom right support includes at least one opening aligned with the first right opening and through which a fastener is installed to secure the first right top/bottom connector to the bottom right support;

the bottom right support includes at least one opening aligned with the second right opening and through which a fastener is installed to secure the second right top/bottom connector to the bottom right support;

the top left support includes at least one opening aligned with the first upper left opening and through which a fastener is installed to secure the first left top/bottom connector to the top left support;

the top left support includes at least one opening aligned with the second upper left opening and through which a fastener is installed to secure the second left top/bottom connector to the top left support;

the top right support includes at least one opening aligned with the first upper right opening and through which a fastener is installed to secure the first right top/bottom connector to the top right support; and the top right support includes at least one opening aligned with the second upper right opening and through which a fastener is installed to secure the second right top/bottom connector to the top right support.

16. The step stool of claim 9, wherein:

the bottom left support includes at least one left upstanding connector extending from the top edge of the bottom left support, the at least one left upstanding connector being adapted for engagement with at least one left opening adjacent a left edge of the stand base; and the bottom right support includes at least one right upstanding connector extending from the top edge of the bottom right support, the at least one right upstanding connector being adapted for engagement with at least one right opening adjacent a right edge of the stand base.

17. A method of detaching a top section of a step stool from a bottom section of a step stool, the top section and bottom section being connected by a plurality of top/bottom connectors, the bottom section including a bottom left support, a bottom right support, a step base and a stand base, the bottom left support and the bottom right support being spaced apart and connected by the stand base and the step base, the stand base being attached to a top edge of the bottom left support and a top edge of the bottom right support, the step base being attached between the bottom left support and the bottom right support, the step base being disposed below the stand base, the bottom section including at least one left opening formed into the top edge of the bottom left support, the at least one left opening being adapted to receive a portion of one of the plurality of top/bottom connectors, the bottom section including at least one right opening formed into the top edge of the bottom right support, the at least one right opening being adapted to receive a portion of one of the plurality of top/bottom connectors, and the top section including a top left support, a top right support, and a lateral support, the top left support and the top right support being spaced apart and connected by the lateral support, the top section including at least one upper left opening extending upwardly into the top left support from a lower edge of the top left support, the at least one upper left opening being adapted to receive a portion of the top/bottom connector disposed in the at least one left opening formed through a left edge of the stand base and into the top edge of the bottom left support, the top section including at least one upper right opening extending upwardly into the top right support from a lower edge of the top right support, the at least one upper right opening being adapted to receive a portion of the top/bottom connector disposed in the at least one right opening, the method comprising the steps of:

removing each of the plurality of top/bottom connectors from the left opening, the right opening, the upper left opening, and the upper right opening; and separating the top section from the bottom section.

18. The method of claim 17, further including positioning a button in each of the left opening, the right opening, the upper left opening, and the upper right opening.

* * * * *